US007245266B1

(12) United States Patent
Szente et al.

(10) Patent No.: US 7,245,266 B1
(45) **Date of Patent: *Jul. 17, 2007**

(54) ANTENNA DIRECTIVITY ENHANCER

(76) Inventors: Pedro A. Szente, 80 E. Portola Ave., Los Altos, CA (US) 94022; Peter P. Tong, 1807 Limetree La., Mountain View, CA (US) 94040; C. Douglass Thomas, 1193 Capri Dr., Campbell, CA (US) 95008

( * ) Notice: Subject to any disclaimer, the term of this patent is extended or adjusted under 35 U.S.C. 154(b) by 0 days.

This patent is subject to a terminal disclaimer.

(21) Appl. No.: 11/245,674

(22) Filed: Oct. 7, 2005

Related U.S. Application Data

(63) Continuation of application No. 10/687,787, filed on Oct. 17, 2003, now Pat. No. 6,977,624.

(51) Int. Cl.
*H01Q 15/20* (2006.01)

(52) U.S. Cl. ..... 343/834; 343/881

(58) Field of Classification Search ..... 343/780, 343/784, 786, 880, 881, 833–841, 914–916, 343/912; 342/8, 10
See application file for complete search history.

(56) References Cited

U.S. PATENT DOCUMENTS 2,270,314 A * 1/1942 Kraus ..... 343/834
2,912,687 A * 11/1959 Nelson ..... 342/8
3,329,960 A * 7/1967 Winegard ..... 343/819
6,115,003 A 9/2000 Kozakoff ..... 343/840
2002/0158807 A1 10/2002 Kuramoto ..... 343/702

OTHER PUBLICATIONS

"Corner Reflector Antennas," NEARSON, Inc (downloaded http://www.nearson.com/index.asp?clickfrom=corner).
"2.4 GHz Antennas—2.4 GHz WLAN WIFI Microwave Parabolic Antenna," Broadcast Warehouse, (downloaded http://www.broadcastwarehouse.com/p/BW/Antennas/2.4-GHz-WLAN-WIFI-Microwave-Parabolic-Antenna?).
J. Kraus, "The Corner-Reflector Antenna," Proceedings of the I.R.E., Nov. 1940.

* cited by examiner

*Primary Examiner*—Michael C. Wimer

(57) ABSTRACT

An antenna directivity enhancer to enhance the directivity of an antenna is disclosed. The enhancer has a 3-dimensional structure in a predefined 3-dimensional shape when operating to enhance the directivity of an antenna. The 3-dimensional structure can be flexibly collapsible into 2-dimensional flat surfaces, with at least two of the surfaces not required to have any space between them when the structure is collapsed. The direction where the directivity is enhanced can be changed as desired. The enhancer can include just one reflecting surface, or at least two reflecting surfaces. In yet another embodiment, the enhancer includes a curved surface when the enhancer is in its predefined 3-dimensional shape.

19 Claims, 26 Drawing Sheets

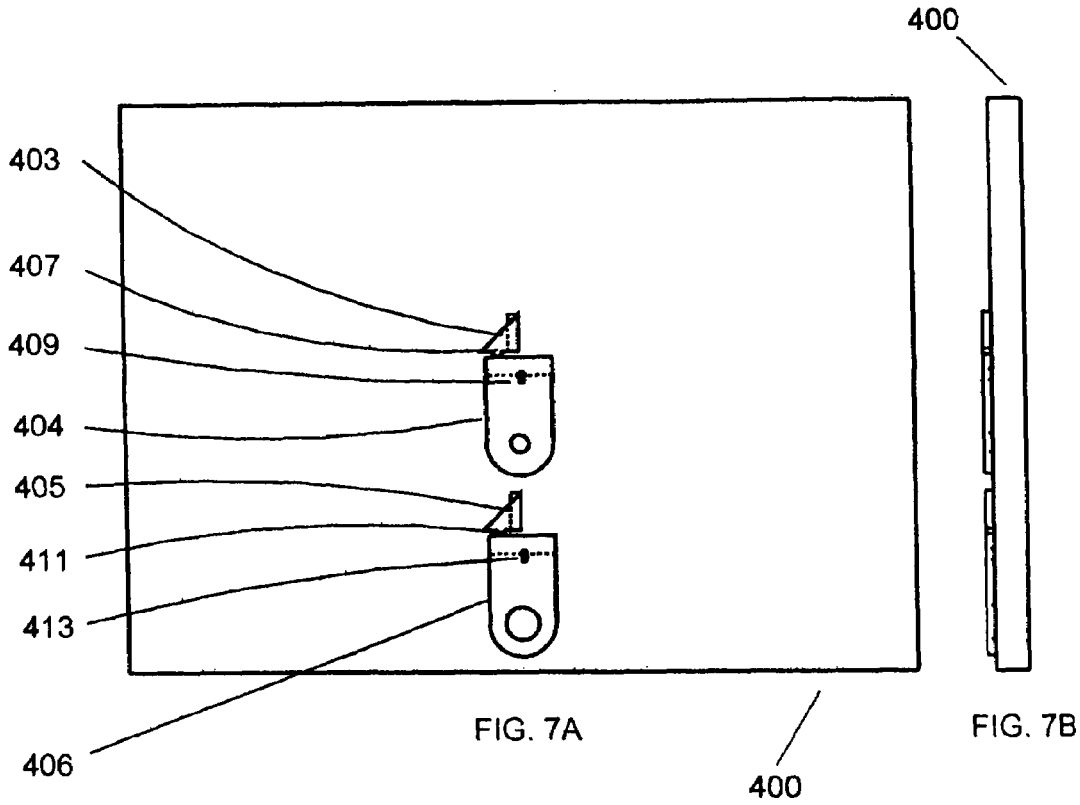
FIG. 7A
FIG. 7B
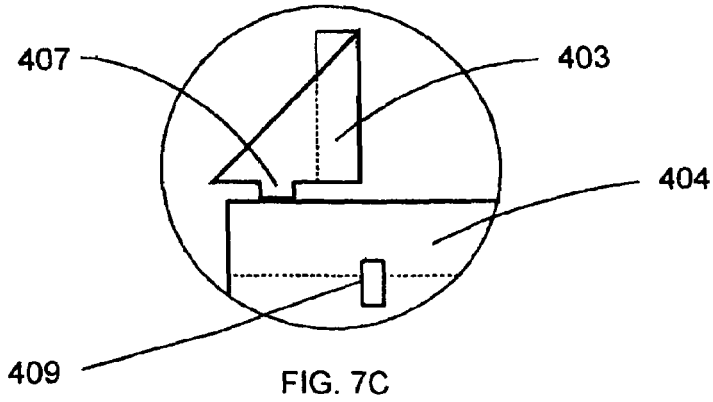
FIG. 7C

ANTENNA DIRECTIVITY ENHANCER

CROSS-REFERENCE TO RELATED APPLICATION

This application claims priority to U.S. patent application Ser. No. 10/687,787, filed Oct. 17, 2003 now U.S. Pat. No. 6,977,624, entitled "Antenna Directivity Enhancer," and which is hereby incorporated herein by reference.

BACKGROUND OF THE INVENTION

1. Field of the Invention

The present invention relates generally to antennas and, more particularly, to a directivity enhancer for an antenna.

2. Description of the Related Art

We live in a networked world. It is not uncommon for a house to have multiple computers, all networked together. In addition to computers, tremendous numbers of electronic devices are deployed all over the world everyday. They can be sensors for collecting information, actuators for providing certain mechanical manipulations, or communication devices, such as cellular phones. Increasingly, electronic devices are also networked together for specific applications. The following descriptions are focused on networked computers. However, similar challenges exist for other electronic devices.

Three common mechanisms used to network computers in an indoor environment are Ethernet, Phone Line (HomePNA) and wireless network. Examples of wireless networks are WiFi and 802.11b. Sometimes these networks are referred to as wireless Ethernet. At present, Ethernet is more popular than the other two approaches for both home and business.

Ethernet networks are relatively stable, and the network speed is typically not prone to interference. In an Ethernet network, special cables running from each computer are connected to a central Ethernet hub or switch. It is quite cumbersome to run cables to connect the computers together, particularly when the computers are far apart.

Phone Line Networks, also known as HomePNA networks, use existing phone lines to wire computers together. The networks allow the same phone-line wires in a house to operate the network. They do not interfere with the normal operation of phone lines for voice, fax or modem use. However, the network requires phone lines to physically connect to the different computers.

Wireless networks are similar to regular Ethernet, except totally wireless networks do not require wires for connections. One common type of wireless networks is the WiFi network, championed by the WiFi Alliance. The WiFi Alliance is a nonprofit international association formed in 1999 to certify interoperability of wireless Local Area Network products based on the IEEE 802.11 specification.

At present, the more common 802.11 networks are the 802.11a and 802.11b networks. The 802.11b network operates around 2.4 GHz and can send data up to 11 Mbps. And, the 802.11a network operates around 5 GHz and sends data up to 54 Mbps. As a result, 802.1 a provides higher bandwidth. On the other hand, the higher operating frequency typically equates to shorter range. For example, the range of 802.11a systems can be up to 60 feet, which is less than the up-to 300 feet operating range of the 802.11b systems.

Computers equipped with wireless cards or embedded wireless antennas can communicate without the need for any additional hardware. However, many homes still use wires to connect computers to the Internet based on a wired Ethernet arrangement. One way to bridge a wired computer to wireless computers is through an access point. One computer in the house can be connected to the Internet through a wire (e.g., coupled to phone or network jack). That computer is also connected through a wire (e.g., cord) to an access point. The access point has an antenna that wirelessly couples to other computers in the house. In other words, the access point can bridge or route wireless traffic to a wired Ethernet network.

Like a cordless phone, once a portable computer is connected to a wireless network, the computer is free to roam a house. Theoretically, you should be able to carry the computer around the house, without losing connections to the network. You should be able to surf the Web sitting in the living room, while watching TV; in the toilet, while brushing your teeth; or on a swing in the backyard. Obviously, the flexibility of wireless networks without tethered connections has its attractions.

However, wireless networks are not without challenges. For example, wireless Ethernet networks operate around 2.4 GHz range. It is the frequency band that is used for many other applications, including satellites, baby monitors, garage-door openers, microwave ovens, Bluetooth networks, and high-end wireless phones. Such a wide range of applications creates interference and increases the noise level on wireless networks.

More importantly, wireless networks operate on radio frequencies. Heavy walls, metal meshes sandwiched inside walls and large metal objects, such as bookshelves and file cabinets, all interfere with radio signals. It is not uncommon for a portable computer to have a relatively stable connection if it is close to an access point, but have problematic intermittent connection if it is used in a different room than the room having the access point. This can cause a lot of frustration to the user of the portable computer who is attempting to use the wireless network.

It should be apparent from the foregoing that there is still a need to improve connections over wireless networks.

SUMMARY OF THE INVENTION

The present invention relates to enhancers for antennas. The enhancers improve the directivity of antennas. Wireless networks offer many advantages, as described above. However, wireless connections can be intermittent. One reason is due to the wireless network antenna. For example, the antenna for an access point, such as a router of a WiFi network, is designed to connect to a computer as long as the computer is in its vicinity, independent of direction. Similar, the wireless card or embedded antenna in a computer is designed to connect to an access point anywhere in its vicinity. The connections should be independent of the relative direction between the computer and the access point. However, there can be large metal objects between the access point and the computer. These objects can create interference patterns. The unfortunate results of the interference are decreased signal strength and intermittent connections. Once a user starts to use a computer, the computer would probably stay stationary for a period of time. It would be beneficial to increase the directivity of the access point antenna and/or the computer antenna, in the specific direction between the computer and the access point. The present invention provides different types of enhancers that can be used to increase the directivity of antennas. Such increase in directivity can often lead to improved connectivity.

In one embodiment, the enhancer includes a 3-dimensional structure with a predefined 3-dimensional shape when operating to enhance the directivity of an antenna. When not operating to enhance the directivity of the antenna, the 3-dimensional structure can be flexibly collapsed into 2-dimensional flat surfaces, with at least two of the surfaces not required to have any space between them when the structure is collapsed. The collapsed enhancer is more portable than the 3-dimensional structure. Another feature of the enhancer is that the direction where the directivity is enhanced can be adjusted as desired. Such flexibility can be used to accommodate the mobility of, for example, portable computers.

Depending on the embodiments, the enhancer can include a corner-horn enhancer, a flat enhancer, a curved enhancer, such as a parabolic enhancer, or enhancers having other shapes.

Regarding collapsibility, in one embodiment, when collapsed, the 2-dimensional flat surfaces remain connected. In another embodiment, the flat surfaces are separate pieces, but can be connected together into the 3-dimensional structure. In yet another embodiment, the enhancer includes an inflatable structure. When fully inflated, the enhancer will be in its pre-defined 3-dimensional shape.

The enhancer can be small, with all of the major dimensions of its pre-defined 3-dimensional shape being, such as less than 12 inches; and lightweight, such as less than 4 ounces.

The enhancer has one or more reflectors. The reflectors can be made of different types of materials. They can be metallic films on lightweight boards, such as poster board. They can be made of thin metallic sheets, such as aluminum alloy sheets. Or, they can be metallic films on plastic films or sheets.

In one embodiment, the enhancer can be attachable by a mechanism such that the enhancer is securely placed at an optimal position to the corresponding antenna. The enhancer can be directly attached to the antenna. An elastic grabber or grommet can be used to further secure the attachment of the enhancer to the antenna.

In another embodiment, there can be a locking mechanism to lock the enhancer in position once the enhancer is attached.

In yet another embodiment, the direction where the directivity should be enhanced can be automatically calibrated. Once calibration is done, the enhancer can be locked in position.

The enhancer can enclose the antenna it is enhancing. This will prevent exposing the antenna. Or, the external 3-dimensional structure of the enhancer can be different from the predefined 3-dimensional shape. These can be for aesthetic reasons.

Two or more enhancers can be used. For example, there are routers with more than one antenna. The multiple antennas can provide a number of benefits, including diversity mode communication. In one embodiment, there can be one enhancer for each antenna on a router. This will allow directivity enhancement in multiple directions simultaneously. In another example, there can be an enhancer for an access point antenna, and another enhancer for the wireless card or embedded antenna of the corresponding portable computer. Such an embodiment would further improve the connections between the access point and the portable computer.

Two or more antennas can be used. For example, there can be more than one antenna on a circuit board to create an antenna structure. An invented enhancer can enhance the directivity of such an antenna structure.

Note that the antenna for a portable computer does not have to be inserted into the computer. The antenna can be connected to one of the computer's I/O ports (sockets), such as its USB port through an USB connector. There can be a cable between the antenna and the port. Different embodiments of the enhancer are designed to improve the directivity of such antenna configurations. In one embodiment, there is a USB connector at the enhancer to allow an antenna to be inserted into the enhancer.

Different embodiments of the invention are applicable to enhance the directivity of different types of antennas, such as an access point antenna, a wireless card antenna and an embedded wireless antenna.

Other aspects and advantages of the present invention will become apparent from the following detailed description, which, when taken in conjunction with the accompanying drawings, illustrates by way of example the principles of the invention.

BRIEF DESCRIPTION OF THE DRAWINGS

FIGS. 7A-7C show different perspective views of a collapsed flat enhancer according to an embodiment of the invention.

Same numerals in FIGS. 1-18B are assigned to similar elements in all the figures. Embodiments of the invention are discussed below with reference to FIGS. 1-18B. However, those skilled in the art will readily appreciate that the detailed description given herein with respect to these figures is for explanatory purposes as the invention extends beyond these limited embodiments.

DETAILED DESCRIPTION OF THE INVENTION

The present invention relates to enhancers for antennas. The enhancers improve the directivity of antennas. We cherish mobility. If possible, we do not want the equipment we are using to restrict our mobility. For example, we may not prefer our equipments to be tethered to a wall because we would then indirectly be tied to the wall. As a result, more and more electronic devices, such as portable computers, are becoming wireless. Wireless devices are coupled through antennas.

Figure 1:
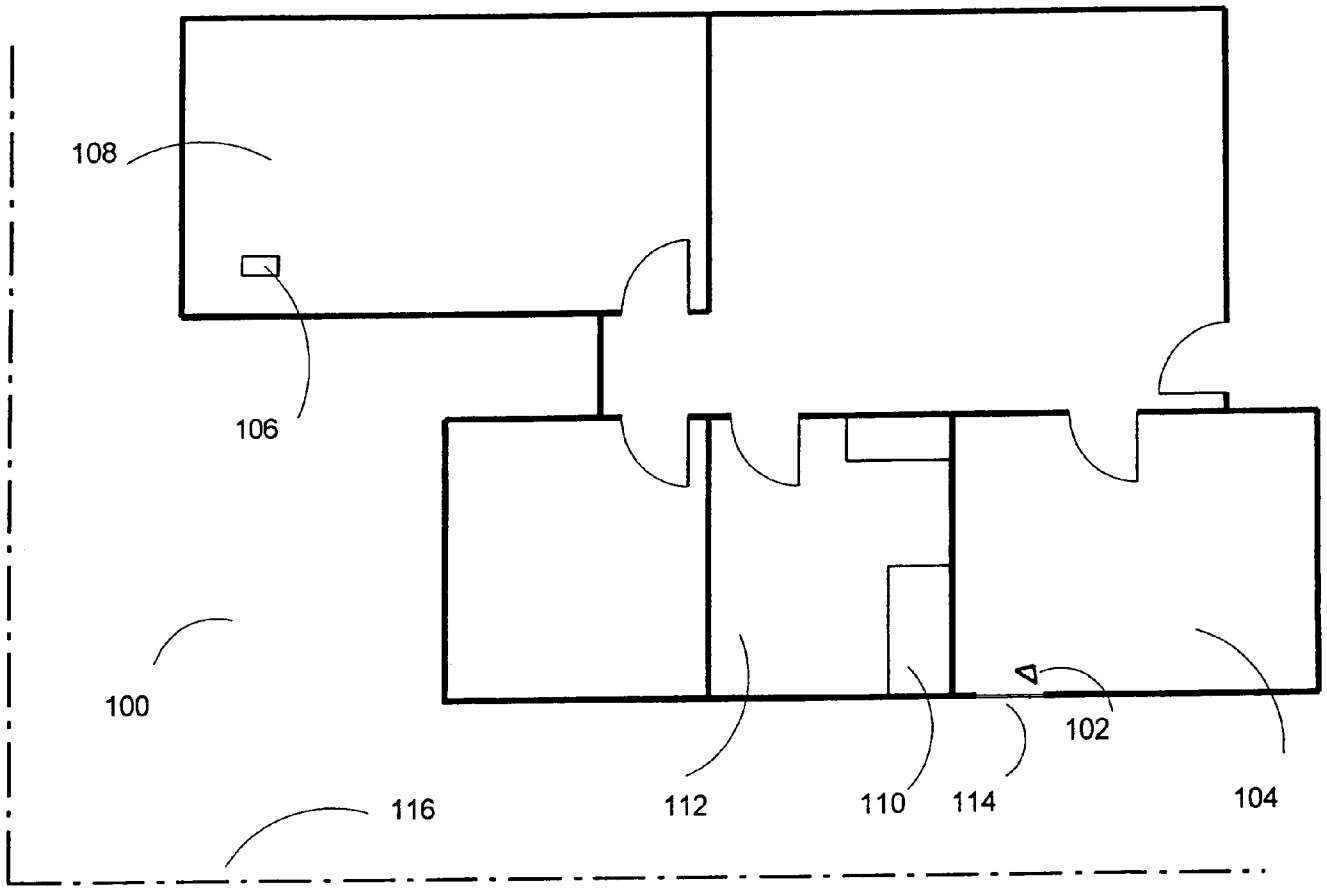
FIG. 1 illustrates an example of using wireless devices in a house.

FIG. 1 illustrates an example of using wireless devices in a house. The figure shows a floor plan 100 of the house, with a number of rooms, 104, 108 and 112. A desktop computer connected to a printer and a wireless router 102 is in a first room 104. In a second room 108, a portable computer 106 wants to establish a wireless connection with the desktop computer. In this example, there are big metal objects in the house, such as a metal shelf 110 in a third room 112. Further assume that walls in this house have metal meshes for structural reasons. Under such situations, it is not uncommon that the connections between the desktop computer and the portable computer can be intermittent. A person walking next to the portable can break the connection. A car driving by the house can enhance the connection. If someone at the portable computer 106 wants to send a picture to the printer, due to the intermittent nature of the connection, the wireless connection can break right in the middle of the transmission. This can be very annoying.

The present invention provides enhancers that enhance the directivity of antennas. In one embodiment, an antenna can be defined as a metallic apparatus designed for the purposes of sending and receiving electromagnetic radiation, and directivity can be defined as the sensitivity of an antenna in certain directions. Through different embodiments of the present invention, the directivity of antennas used by devices can be enhanced, which implies increasing the sensitivity and/or signal strengths of the antenna in certain directions. The quality of the wireless connections with the devices can then be improved.

Figure 2A:
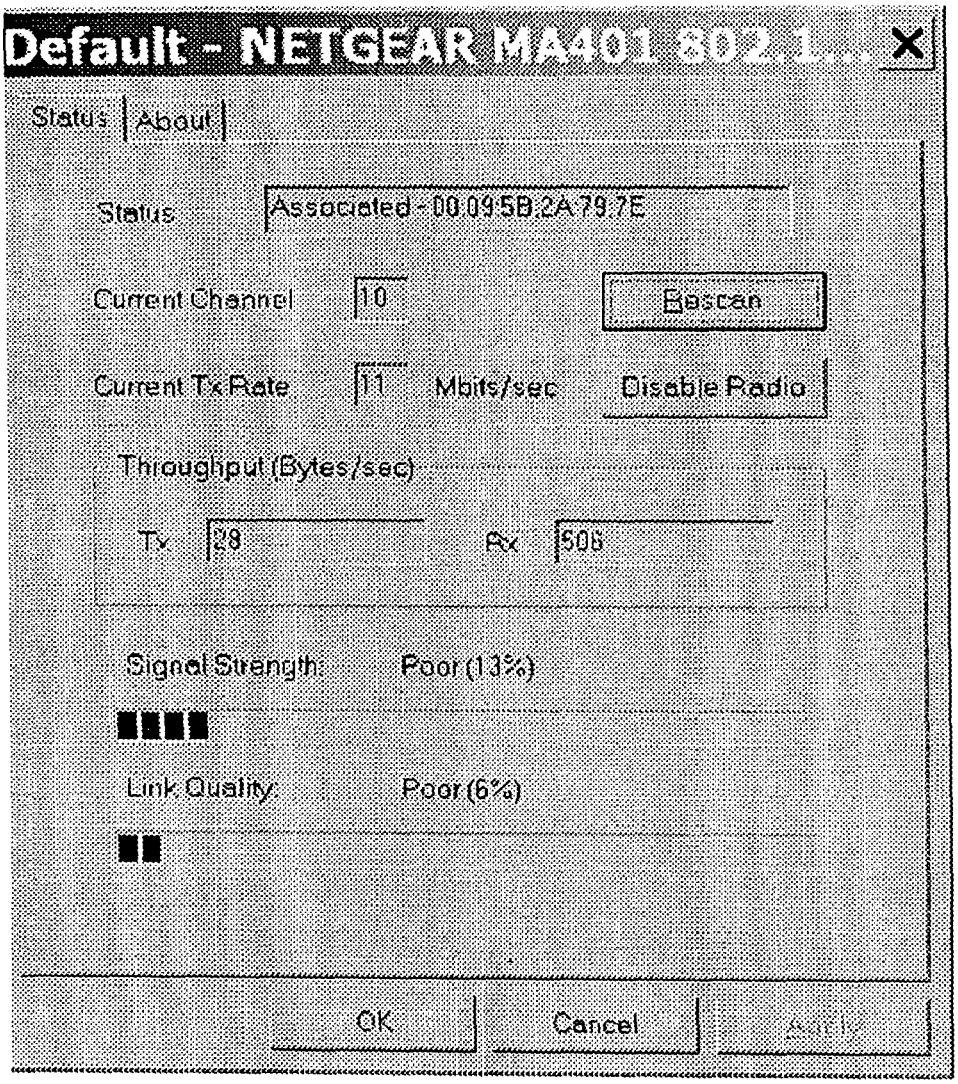
FIGS. 2A-2B illustrate examples of improvements in signal strengths according to one embodiment of the invention.
Figure 2B:
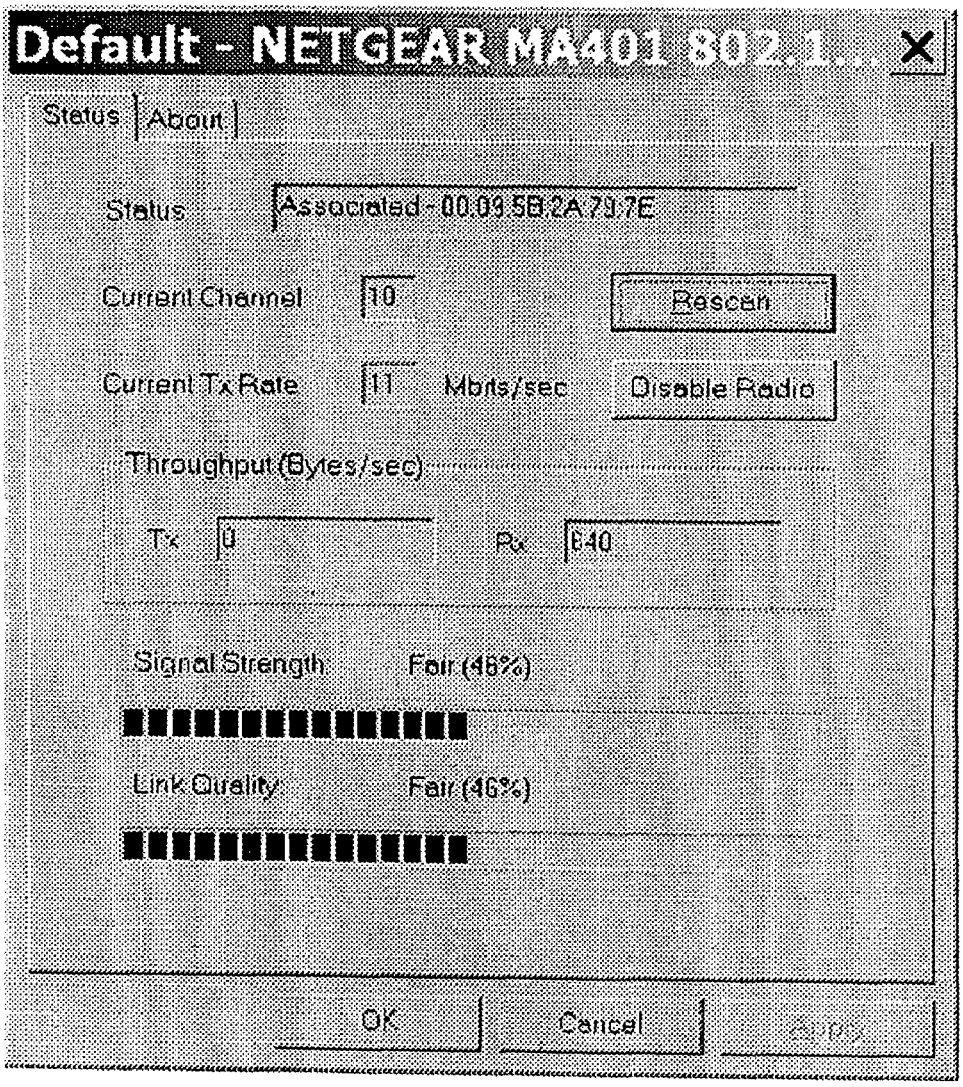

FIGS. 2A-2B illustrate examples of improvements in signal strength of the wireless router 102 according to one embodiment of the invention. Again, the router 102 is trying to establish connection with the portable computer 106. FIG. 2A shows the poor signal strength (and link quality) of the router 102 with no enhancer. FIG. 2B shows significant improvements in signal strength (and link quality) of the router 102 using a corner-horn enhancer according to one embodiment of the invention. In this example, the corner-horn enhancer increases the directivity of the router antenna in the directions out of a window 114 of the house. The signals propagating out of the window 114 are incident on different objects, such as 116, outside the house. Some of these incident signals are reflected back and received by the portable computer 106.

Figure 3:
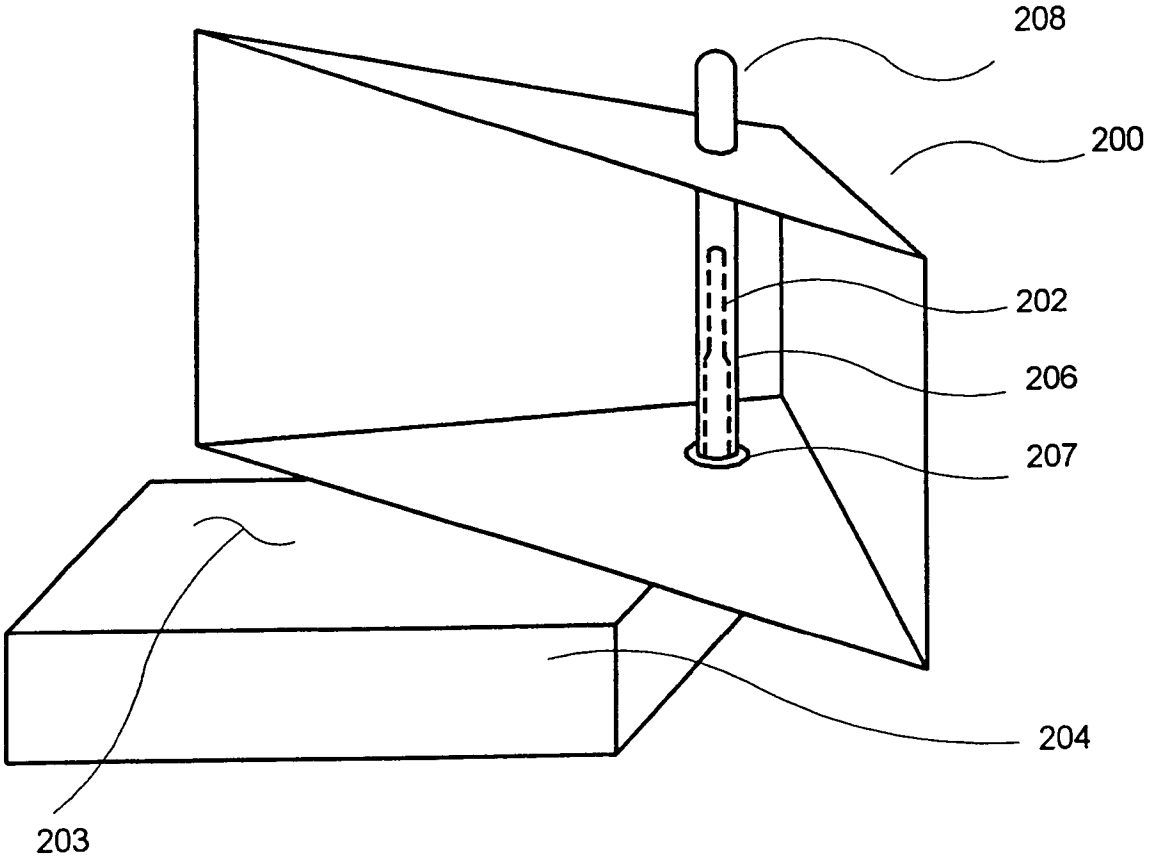
FIG. 3 shows a corner-horn enhancer coupled to the antenna of a router according to one embodiment of the invention.

FIG. 3 shows one embodiment of an enhancer 200 coupled to the antenna 202 of a wireless router 204. The enhancer 200 is known as a corner-horn enhancer.

In one embodiment, the enhancer 200 makes use of a non-metallic or insulating tube 206. The tube 206 can be inserted into the enhancer 200 after the enhancer has been expanded into its predefined 3-dimensional shape. The tube 206 helps fix the position of the antenna 202 relative to the enhancer 200. The tube 206 also encloses the antenna 202. In another embodiment, the enhancer 200 can further include the non-metallic or insulating tube 206. There can be a cap 208 at the end of the tube 206.

Figure 4C:
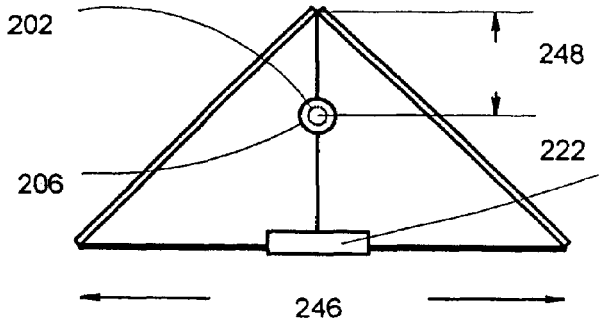
FIGS. 4A-4E show different perspective views of a corner-horn enhancer according to an embodiment of the invention.
Figure 4B:
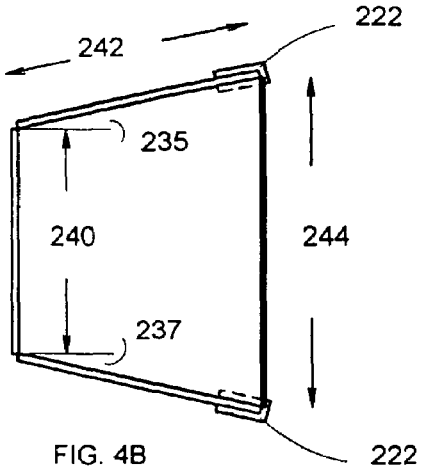
Figure 4A:
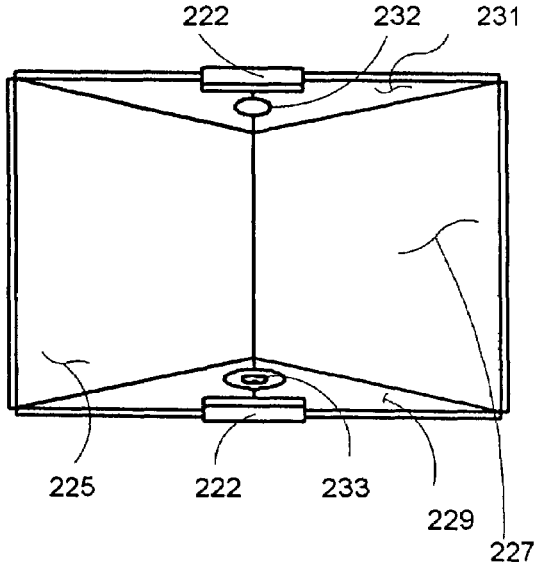

FIGS. 4A-4D show different perspective views of the corner-horn enhancer 200. FIG. 4A shows the front view of the enhancer 200. It has four inner surfaces—two side inner surfaces, 225 and 227, a bottom inner surface 229 and a top inner surface 231. The top surface 231 is generally above the side surfaces, and the bottom surface is generally below the side surfaces. The terms, top, bottom and sides, are used to show how the surfaces are positioned, relative to each other. In the orientation shown in FIG. 4A, the top surface is above the side surfaces, and the bottom surface is below the side surfaces. However, the router 204 can be mounted on the ceiling, with the enhancer attached. In such a configuration, the top surface 231 may be more appropriately known as the bottom surface, and vice versa. Anyway, for illustration purposes, the terms, top, bottom and sides, are still used to show the relative positions of the surfaces.

In one embodiment, all four inner surfaces are reflecting surfaces, such as metallic surfaces. Here, reflecting implies capable of reflecting electromagnetic radiation, such as in the range of 500 MHz to 6 GHz. In another embodiment, the top and the bottom surfaces are not metallic.

When the enhancer is in its predefined 3-dimensional shape, the two side or dihedral surfaces, 225 and 227, are substantially orthogonal to each other. The vertex of the enhancer can be defined as the line where the two side surfaces intersect. Each of the top and the bottom surfaces has a hole, 232 and 233, for positioning the tube 206.

FIG. 4B shows a side view of the enhancer 200, looking from the outside. In one example, the height 240 at the vertex is 6.5", the length 242 of the side surface is 9.6", and the height 244 at the mouth of the enhancer is 9.5". The relative dimensions of the vertex height 240 versus the mouth height 244 can be changed. This can either create an upward-tilted angle 235 for the top surface 231, or a downward-tilted angle 237 for the bottom surface 229, or both. For example, if the portable computer 106 is usually positioned at a higher elevation than the wireless router, in one embodiment, the downward tilted angle 237 can be made to be substantially zero, while the upward tilted angle 235 can be made to be 30 degrees. Based on different embodiments, the upward-tilted angle and the downward-tilted angle can be made to be between 0 to 45 degrees.

Figure 4D:
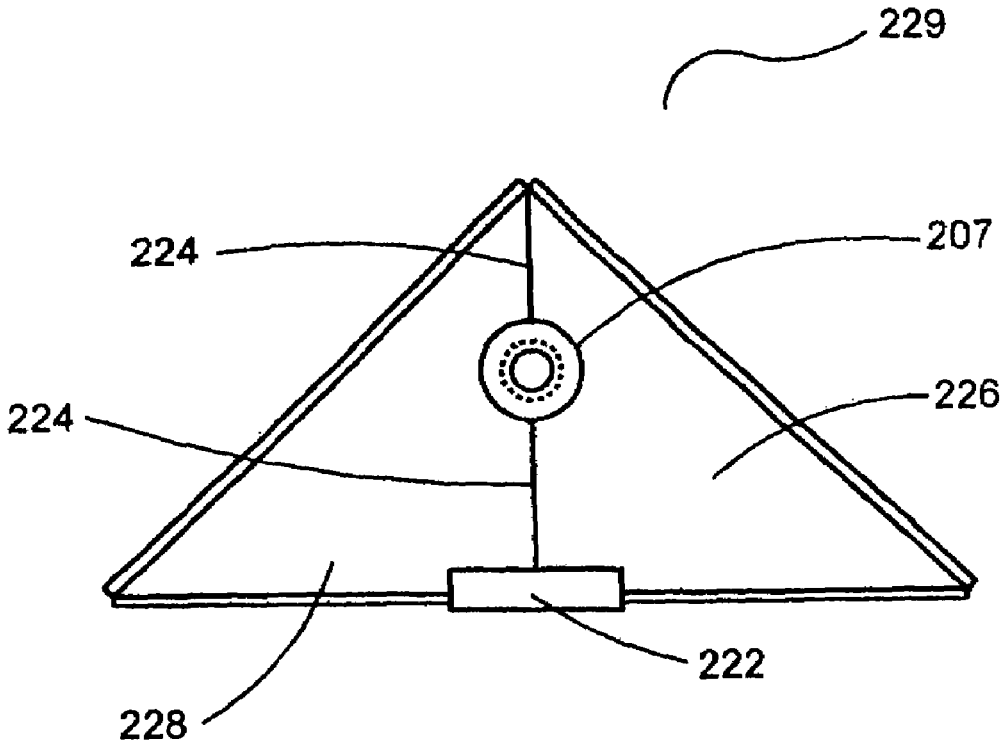

FIG. 4C shows a top view of the enhancer 200, looking from the outside, and FIG. 4D shows an embodiment of the bottom surface 229. The top and the bottom surfaces, 231 and 229, are triangular in shape, and they are substantially the same. Each of those surfaces can be formed by two equal half-surfaces, or can be bisected into two equal half-surfaces. For example, the bottom surface 229 can be bisected into two half-surfaces 226 and 228, separated at the bisecting centerline 224. In one example, the width 246 of the top surface is 13.4". The center of each hole in either the top or the bottom surface is substantially on the bisecting centerline 224. The position of the holes would be further described below.

In one embodiment, the enhancer is relatively small. For example, when the enhancer is in its pre-defined 3-dimensional shape, all its major dimensions are less than 34 centimeters (cm). In yet another example, the enhancer is scaled down by 30%, with all of its major dimensions being less than about 24 inches. One definition of major dimensions is as follows. Imagine the enhancer is housed in a rectangular box. The volume of the box is the smallest possible but can still encapsulate the enhancer in its pre-defined 3-dimensional shape. The major dimensions of the enhancer are the length, width and height of the rectangular box.

In another embodiment, the enhancer 200 is relatively lightweight. To provide the enhancer 200 with structural strength and to keep its weight light, the enhancer can be made of metallic films on lightweight boards. For example, the metallic films can be aluminum films and the lightweight boards can be poster board, carton boards or plastic foam. In one embodiment, the enhancer 200 is less than 4 ounces in weight. In another embodiment, the boards are 3 millimeters (mm) thick.

One approach to attach the enhancer 200 to the antenna 202 of the wireless router is to first insert the tube 206 through the two holes 232 and 233. The bottom of the tube can be about flush with the bottom of the bottom surface 229. Then, position the tip of the antenna 202 at the bottom hole 233 of the enhancer, and insert the antenna 202 through the bottom hole 233 into the tube 206, until the enhancer 200 is supported by the top surface 203 of the router 204. By rotating the enhancer 200 relative to the antenna, the direction where the directivity is enhanced can be changed as desired.

As described, the enhancer 200 can be attached to the antenna through the tube 206. This will help locate the enhancer 200 securely relative to the antenna 202 at an optimal position. In one embodiment, the distance 248 between the vertex and the center of holes, such as the hole 232 in the top surface 231, is more than 0.25, but less than 0.75, of the wavelength of the carrier signals from the wireless router. For example, if the carrier frequency is 2.4 GHz, the distance 248 is between about 3.1 cm and 9.3 cm. In another example, that distance 248 is about half of the wavelength of the carrier signals. In yet another example, the distance 248 is at a geometrical point optimal for enhancing the connectivity between the portable computer and the wireless router. The point is approximately the focal point of the antenna in the enhancer, or where electromagnetic energies are substantially focused, or where electromagnetic energies are most efficiently coupled and received.

In one embodiment, the mechanism to attach together the antenna and the enhancer is improved by having an elastic grabber 207 at, for example the bottom hole 233. The elastic grabber 207 can be a grommet. The grabber can increase the frictional force between the 3-dimensional structure and the tube 206 when the tube is inserted into the holes. Or, there can be a grabber inside the tube 206 to enhance the frictional force between the tube 206 and the antenna 202. With such devices in place, the enhancer 200 can be more securely attached to the antenna even when the wireless router is mounted, for example, upside down on a ceiling.

In one embodiment, the enhancer 200 can be flexibly collapsed. The term, flexibly, can imply that the enhancer 200 can be collapsed and expanded as desired. The enhancer 200 can be made of metallic films on lightweight boards. Referring back to FIGS. 4A and 4D, there can be altogether 6 separate boards. They are respectively the two boards for the two side surfaces 225 and 227, and four boards for the two sets of half-surfaces, one set for the top surface 231 and the other set for the bottom surface 229. The boards are connected together by films on the surfaces, which in this example, are all metallic films or sheets.

Figure 5A:
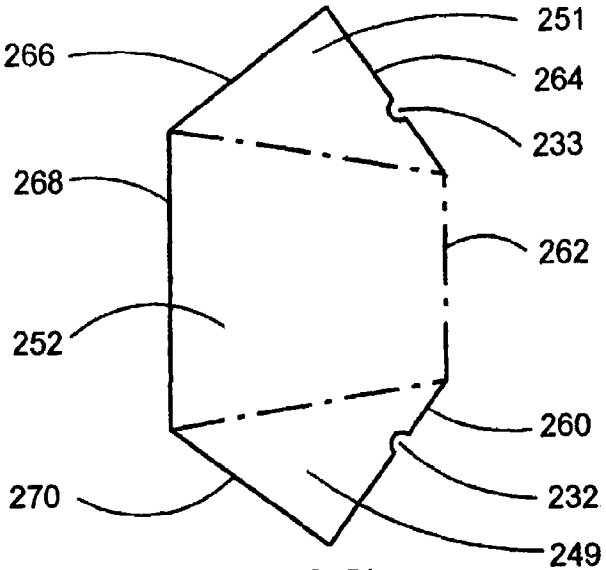
FIGS. 5A-5D show different perspective views of a corner-horn enhancer, in different degrees of collapsibility, according to an embodiment of the invention.
Figure 5D:
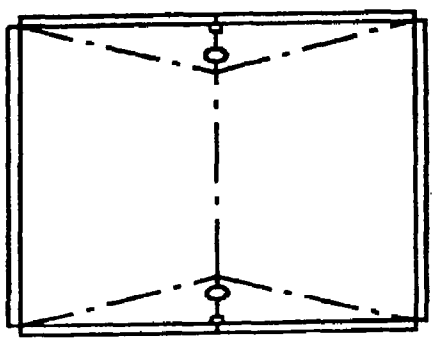
Figure 5B:
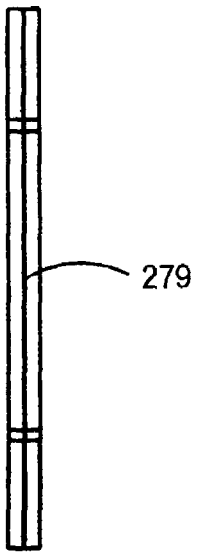

One way to collapse the enhancer 200 is to first remove the enhancer from the antenna of the wireless router. For the embodiment with the tube 206, remove the tube 206, with its cap 208, from the 3-dimensional structure. The pre-defined 3-dimensional shape is ready to be collapsed. One approach is to bend the two half-surfaces of the top surface 231, and the two half-surfaces of the bottom surface 229 together, until the two half-surfaces of the top surface 231 touch each other, and the two half-surfaces of the bottom surface 229 touch each other. When that happens, the enhancer 200 would have been collapsed into 2-dimensional flat surfaces, as shown in FIGS. 5A-5B, with at least two of the surfaces not required to have any space between them. For example, the two dihedral surfaces 225 and 227, when collapsed, can be in contact. They do not need to have any space between them.

In another example, when collapsed, the angle subtended between two of the surfaces can be reduced by at least a factor of four. When the enhancer is expanded into its predefined 3-dimensional shape, the angle subtended by the dihedral surfaces, 225 and 227, is about 90 degrees. When collapsed, the angle between them can be less than a few degrees.

FIG. 5A shows the outside view, while FIG. 5B shows the side view, of the collapsed enhancer 200, illustrating the collapsed enhancer becoming two substantially parallel boards or plates. Each board is composed of three connected parts—one half-triangle 249 from the top surface 231, a trapezoid 252, and one half-triangle 251 from the bottom surface 229. With the two boards, there are altogether six parts. The six parts of the collapsed structure exposes six edges, 266, 268, 270, 260, 262 and 264. The boards are connected together by films or sheets at some of the edges. Metallic films or sheets connect a number of the edges, 260, 262 and 264, but not in the areas of the holes, 232 and 233. The remaining edges 266, 268 and 270 are not connected.

FIG. 5B shows the side view of the two boards strengthening the metallic films. The 2-dimensional flat metallic surfaces can be touching each other and are shown as the line 279 between the boards.

Figure 5C:
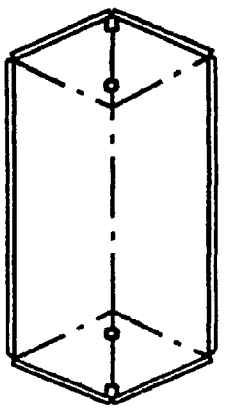

To expand the collapsed enhancer back into its pre-defined 3-dimensional shape, one approach is to separate the flat metallic surfaces at the edges 266, 268 and 270 that are not connected. FIG. 5C illustrates a partially-expanded (or partially-collapsed) enhancer. The separation continues until the two half-surfaces of the top surface 231 becomes a plane, and the two half-surfaces of the bottom surface 229 also become a plane. At that point, the enhancer would be transformed back into its pre-defined 3 dimensional shape, as shown in FIG. 5D.

Figure 4E:
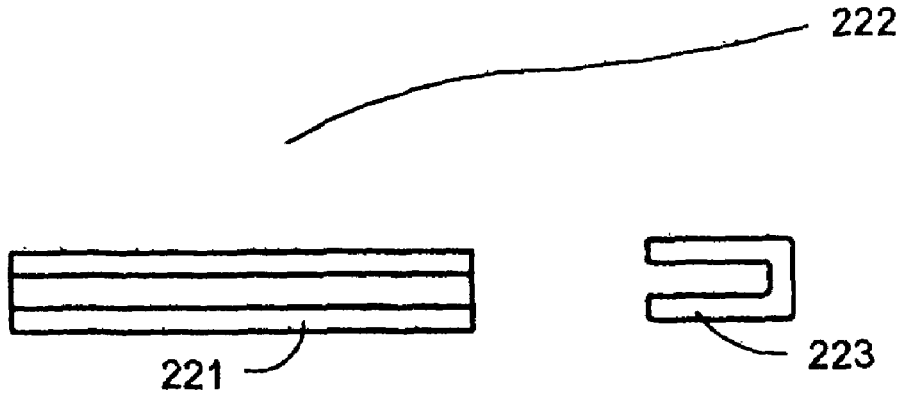

In one embodiment, to strengthen the pre-defined 3-dimensional shape, there can be a clip 222 at each of the top and the bottom surfaces, 231 and 229. FIG. 4E shows the front 221 and the side 223 view of such a clip according to one embodiment. The clips are at the mouth of the enhancer and in the vicinity of the two bisecting centerlines. For example, as shown in FIG. 4D, when the enhancer 200 is in its pre-defined 3-dimensional shape, a clip 222, which can be a plastic clip, holds the two half-surfaces, 226 and 228, so as to form a plane. In other words, the clip 222 can help maintain the enhancer in its pre-defined 3-dimensional shape.

In the above description, the enhancer 200 is a corner-horn enhancer, with at least two inner reflecting dihedral surfaces. However, it should be noted that the enhancer can be configured to have various different shapes.

Figure 6:
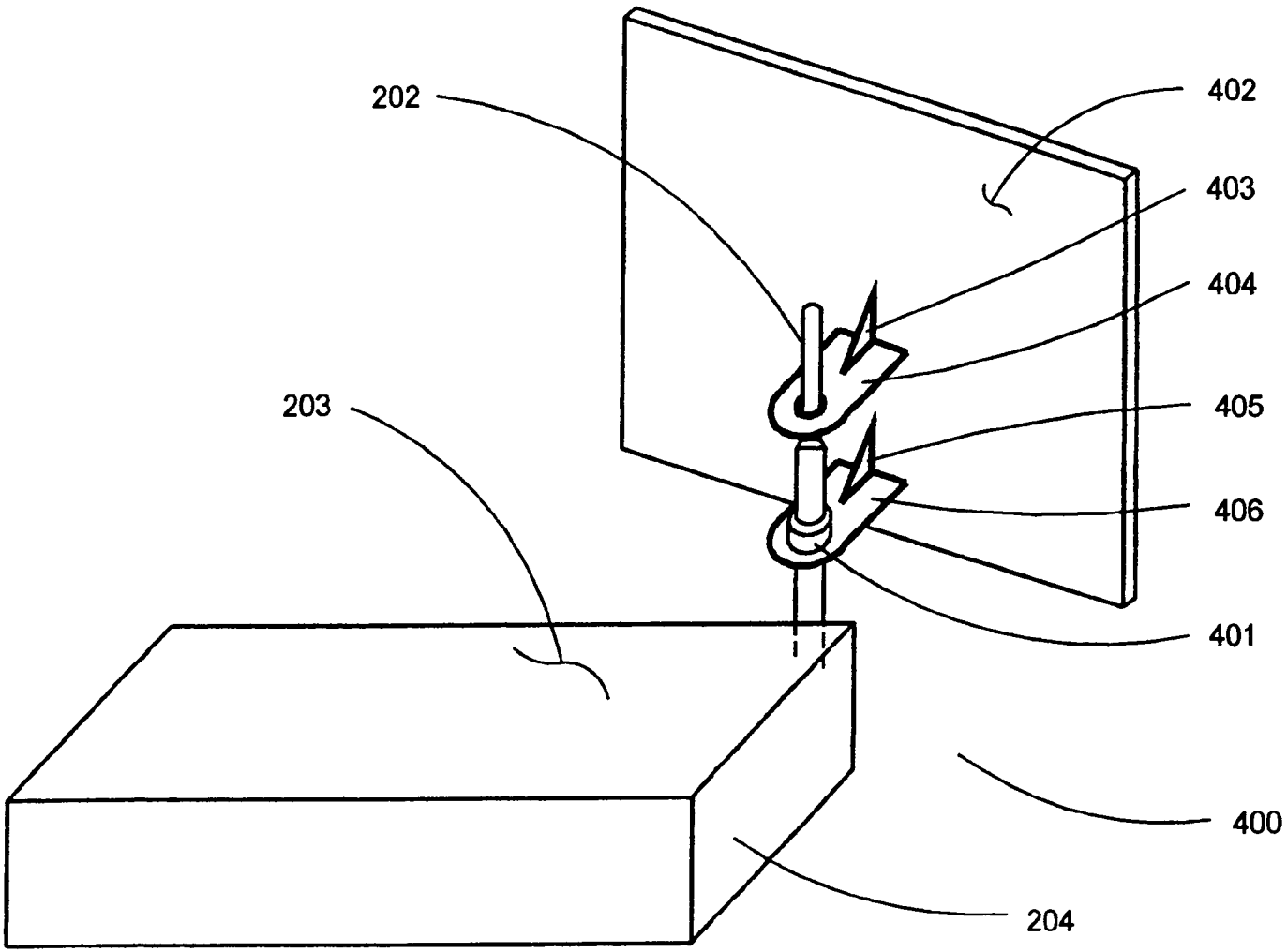
FIG. 6 shows a flat enhancer coupled to the antenna of a router according to one embodiment of the invention.

FIG. 6 shows a flat enhancer 400 coupled to the antenna 202 of the wireless router 204 according to another embodiment of the invention. This flat enhancer 400 only has one reflecting or metallic surface 402 on a board or plate, and a number of tabs, 403, 404, 405 and 406. In the figure, two of the tabs, 404 and 406, are holding tabs. They hold the flat enhancer 400 in place. Two of the other tabs, 403 and 405, are locking (or supporting) tabs. They are not necessary, but they further lock the two holding tabs in their appropriate positions. The tabs are made of insulating materials. When attached to the antenna 202 of the wireless router 204, the enhancer 400 would be in its pre-defined 3-dimensional shape. The antenna 202 goes through the two holes in the holding tabs. The tabs are also locked in a substantially perpendicular manner to the reflecting surface 402, with one edge of the board of the reflecting surface supported by the top surface 203 of the router. When attached, the holding tabs position the enhancer relative to the antenna at an optimal position. The distance between the center of the holes and the reflecting surface 402 sets the optimal position. In one embodiment, that distance is close to 0.25 or 0.75 of the wavelength of the carrier signals of the wireless router.

FIGS. 7A-7C show different perspective views of one embodiment of a collapsed flat enhancer 400. FIG. 7A shows the top view and FIG. 7B shows the side view, while FIG. 7C provides a magnified view of a portion of a locking and a holding tab. When collapsed, the tabs can be folded down, with their surfaces substantially touching the reflecting surface. As a result, no space is required between such surfaces. Also, when collapsed, the 2-dimensional surfaces of the enhancer 400 are connected. In the figures, the two holes in the two holding tabs are different in sizes to accommodate some router antennas that change in dimension, as shown, for example, in FIG. 6. To have a better fit for such antennas, the two holes can be of different sizes.

FIG. 7C provides a magnified illustration of one embodiment of a locking tab 403 and its corresponding holding tab 404. When the enhancer is collapsed, both tabs can be folded down. The locking tab provides a mechanism to lock the holding tab in its right position when the enhancer is in its pre-defined 3-dimensional shape. Note that the locking tab 403 has an extension 407, and the holding tab 404 has a hole 409. When expanded into its pre-defined 3 dimensional shape, both the locking and the holding tabs become L-shaped brackets, for example, the knee of the bracket of the holding tab 404 is at the dotted line. Then the extension 407 can be inserted into the hole 409 to have the position of the holding tab fixed relative to the reflecting surface 402.

Again, there can be an elastic grabber, such as a grommet 401, inside the holes of the holding tabs to better secure the enhancer to the antenna, or to better lock the enhancer in place.

Figure 8A:
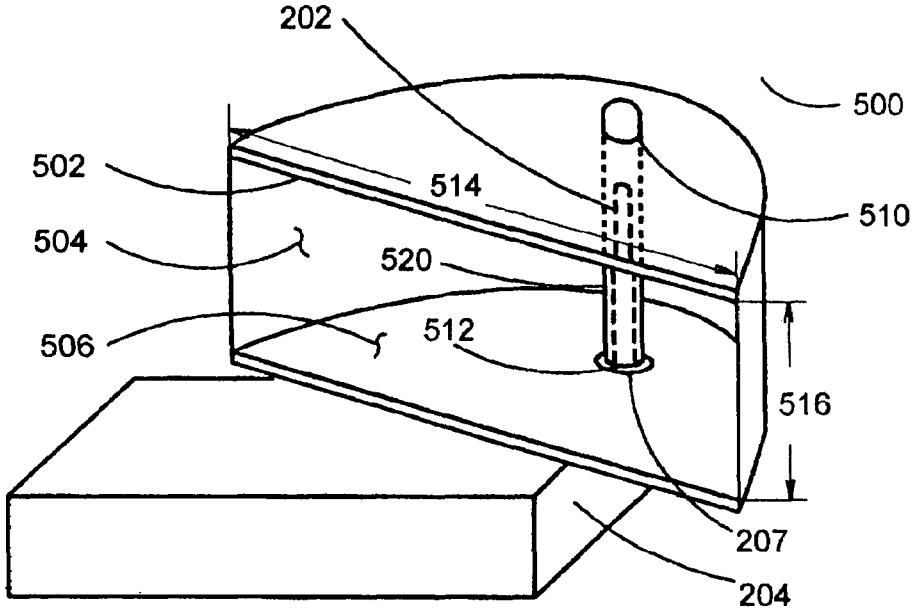
FIGS. 8A-8C show different perspective views of curved enhancers according to two embodiments of the invention.
Figure 8B:
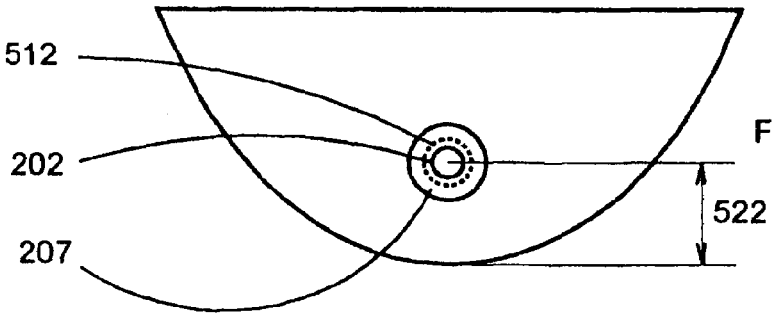

In yet another embodiment, the predefined 3-dimensional shape of the enhancer 500 can include a curved reflecting inner surface 504, as shown, for example in FIGS. 8A-8B. In the figures, the curved surface is a concave reflecting surface; it is on a thin, flexible film or sheet. The enhancer 500 also includes a top inner surface 502 on a top plate, and a bottom inner surface 506 on a bottom plate.

In one embodiment, the top and the bottom inner surfaces, 502 and 506, of the enhancer 500 are reflecting or metallic surfaces. In another embodiment, both the top and the bottom inner surfaces, 502 and 506, are non-metallic surfaces. The top and the bottom plates have holes, 510 and 512, for positioning the enhancer 500 relative to the antenna 202 of the wireless router. Again, there can be an insulating tube 520 for the antenna to insert into.

In another embodiment, the curved metallic surface can be parabolic in shape, and the enhancer is known as a parabolic enhancer. The enhancer is substantially symmetrical about the focus of the parabola, which sets the curvature of the curved surface. The centers of the holes are substantially located at that focus, and the distance between that focus of the parabola and its vertex is about ½ of the wavelength of the carrier frequency. In one embodiment, the distance between the centers of the holes and the vertex of the parabola is between ¼ to ¾ of the wavelength of the carrier frequency; and at the mouth of the enhancer, its width 514 is 10", and its height 516 is 7.5".

Figure 8C:
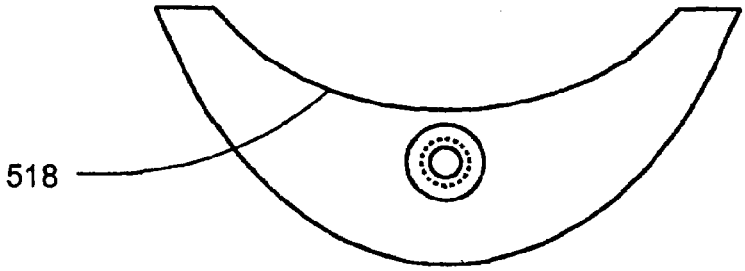

FIG. 8C shows another embodiment of the parabolic enhancer in which a portion of the top and the bottom plates are removed. One benefit of the removal is to reduce the weight of the enhancer. With the cut-out portion, the width of the plate is tapered, widest or strongest close to the middle in the vicinity of the antenna, and gradually narrowing off towards the edges. In one embodiment, the shape of the taper is substantially exponential.

Figure 9B:
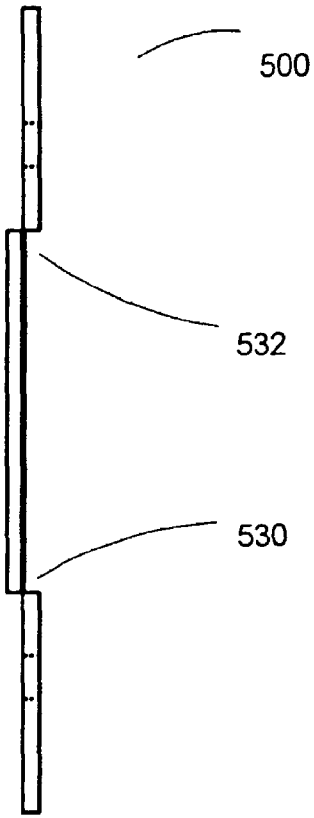
FIGS. 9A-9B show two perspective views of a collapsed curved enhancer according to an embodiment of the invention.
Figure 9A:
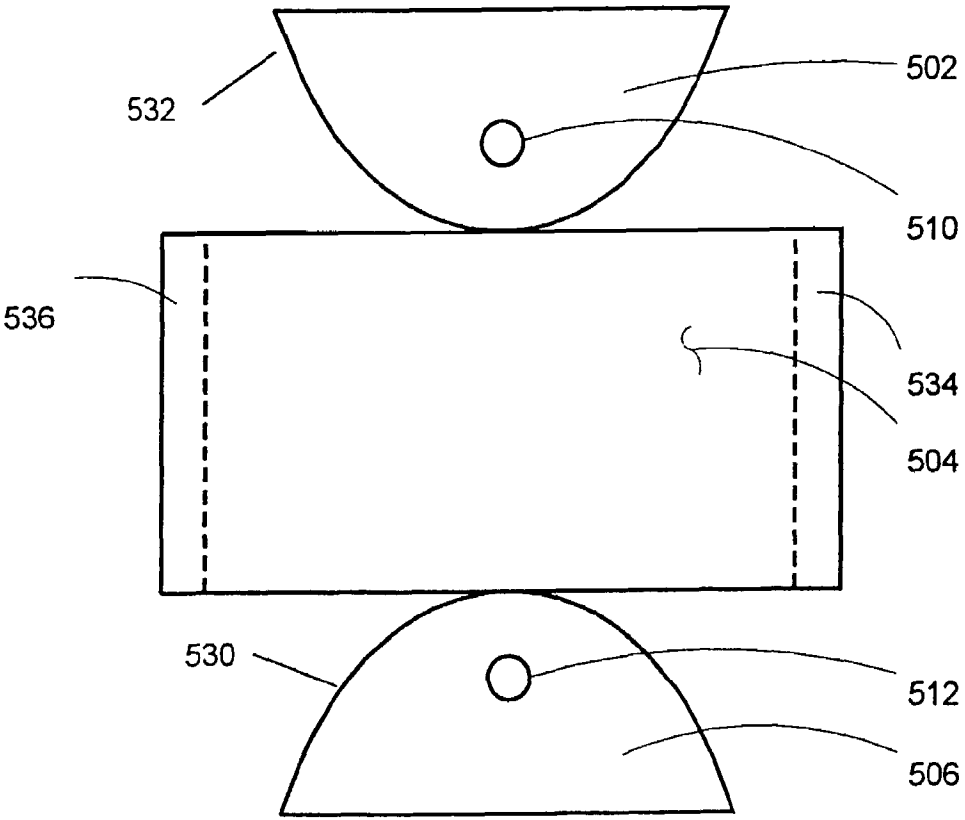

Again, in one embodiment, the parabolic enhancer can be flexibly collapsible into 2-dimensional flat surfaces. FIGS. 9A-9B show a top and a side view of the parabolic enhancer 500 that is collapsed. When collapsed, the sheet or film with the reflecting curved surface 504 can be substantially flattened. The flattened curved surface 504 is connected to the top surface 502 and the bottom surface 506 at the edge of the vertex of the enhancer 500.

Typically, the top surface 502 and the bottom surface 506 are on rigid lightweight boards or plates, such as poster boards, while the concave surface can be a thin metallic film, or can be on a metallic surface on flexible sheet or film. In one embodiment, the curved reflecting surface 504 on a film is made of a metallic film on a card. The card can be less than 0.5 millimeters thick. At the two edges of the card where the mouth of the enhancer 500 is located, there can be two strips, 534 and 536. The strips can be made of lightweight board materials to provide structural support for the surface 504.

To further conserve space when the enhancer is collapsed, in one embodiment, the top and the bottom surfaces, 502 and 506, can be folded over the flattened flat surface 504. Note that this folding process can be flexible. The top plate with the top surface 502 can be folded over the front side or the back side of the flat surface 504. Similarly, that can also be the case for the bottom plate with the bottom surface 506. After such folding, no space is required between the surfaces. In other words, the top plate can be in contact with the flexible sheet. In between the top surface 502 and the flat surface 504, there can be only materials for the top plate and the flexible sheet. In this case, no space is required can imply no free space.

FIGS. 10A-10D show two embodiments to expand the collapsed curved enhancer back into its predefined 3-dimensional structure. Both of them rely on techniques to re-attach the flattened-curved surface back to the top and the bottom plates of the curved enhancer 500.

Figure 10B:
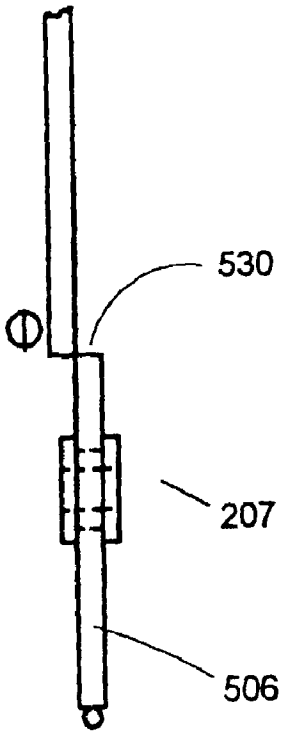
FIGS. 10A-10D show different views of two mechanisms to attach the curved surface to the top or bottom surfaces of a curved enhancer according to different embodiments of the invention.
Figure 10A:
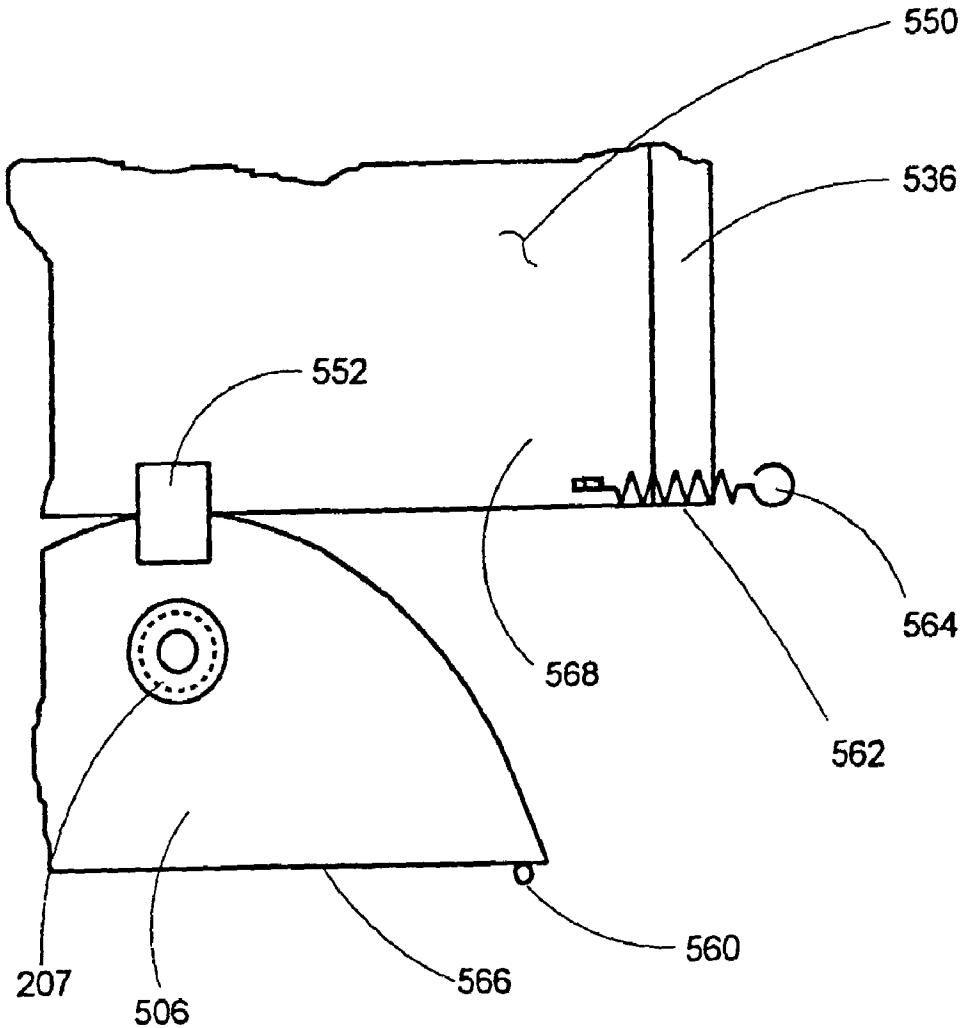

FIGS. 10A-10B show an embodiment that uses balls and springs with rings. The figure depicts the backside 550 of the flattened-curved surface 504, or, the backside of the film with the flattened-curved surface 504. A portion of one of the strips 534 is also shown. As described above, the film with the flattened-curved surface 504 is connected to the bottom surface 506 at one edge of the vertex of the enhancer 500.

FIG. 10A shows a piece of adhesive tape 552 that connects the two surfaces together. Though connected by an adhesive material, when the enhancer is collapsed, the plates for the top and bottom surfaces 502 and 506 are relatively free to swing relative to the film with the flattened-curved surface 504.

In the embodiment shown in FIGS. 10A-10B, there can be a spring with its corresponding ring in the vicinity of each corner on the backside 550 of the film with the flattened-curved surface. For every ring, there is a ball. Two of the balls are on the top plate and two on the bottom plate.

For the parabolic enhancer 500 shown in FIGS. 9A-B, the top and the bottom surfaces can be reflecting. They can be on parabolic-shape boards. These boards have thickness. For each board, at the two ends substantially furthest away from the vertex, on its sidewall, there can be a ball. FIG. 10A shows the ball 560 at one of the ends 566 of the bottom surface, on the sidewall of the board.

In one embodiment, to expand the enhancer of the embodiment shown in FIGS. 10A and 10B, one can swing the top and the bottom plates towards each other and towards the reflecting surface 504. The goal is to position the two plates so that they are substantially parallel and orthogonal to the reflecting surface 504. Then, wrap the sheet or film with the reflecting surface around the parabolic edges, 530 and 532, of the plates. The next step is to stretch the four springs, one at a time, to snap each ring into its corresponding ball. For example, one can stretch the spring 562 to snap the ring 564 onto the ball 560. With all four of the springs hooked onto the four balls, the collapsed enhancer would be expanded back into its predefined 3-D shape, or its intended operational shape.

Figure 10D:
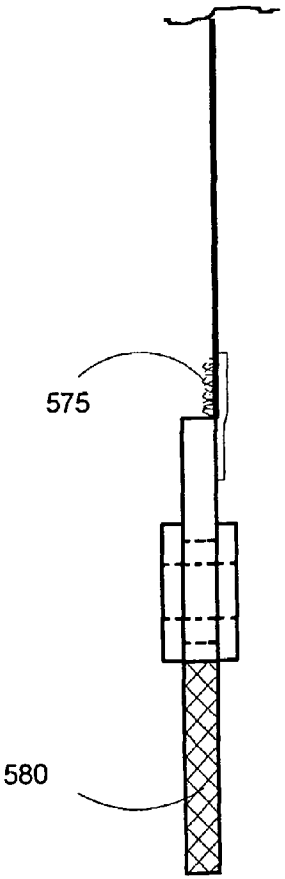
Figure 10C:
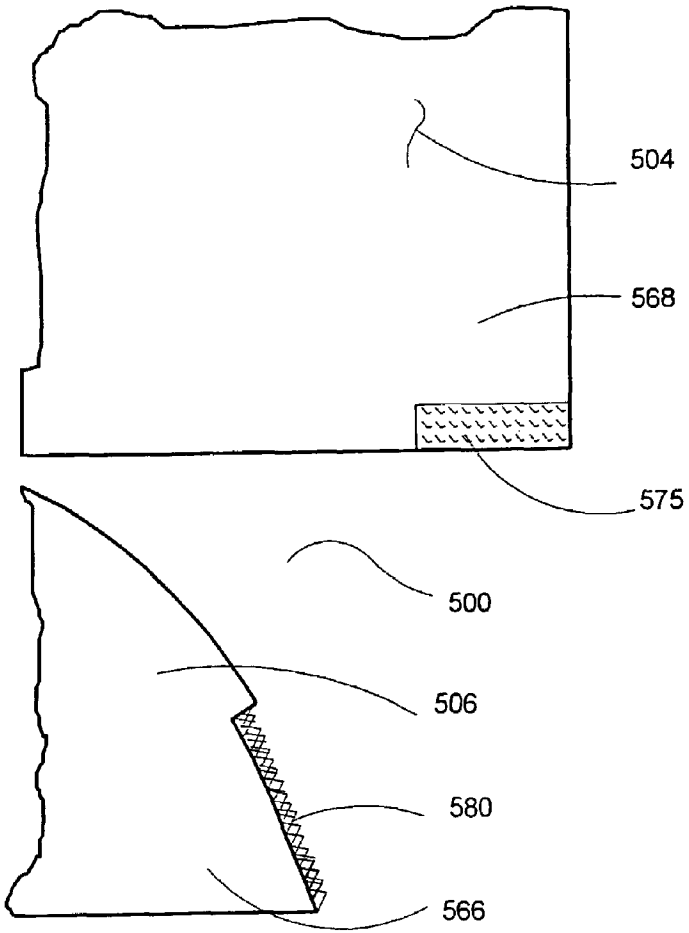

FIGS. 10C-10D show another mechanism to expand a flattened-curved enhancer. Instead of rings and balls, this embodiment uses VELCRO™, or removable hooks and loops for attachments.

FIG. 10C shows the flattened-curved surface 504 and the bottom surface 506. There can be a piece of VELCRO™ in the vicinity of each corner of the flattened-curved surface. FIG. 10C shows a sheet of hooks 575 at one of the corners 568. In this example, the sheet or film for the curve surface 504 may not have any strips on its backside.

Again, the inner surfaces of the top and bottom plates can be reflecting surfaces. Each plate has one edge that is parabolic in shape. For each board, at the two ends substantially furthest away from the vertex, on its side wall, there can be an indentation with a sheet of loops. FIG. 10C shows a sheet of loops 580 at one end portion 566 of the bottom plate, in a recess on the edge of the plate.

To expand the enhancer, swing the bottom surface 506 towards the flattened-curved surface 504, wrap the bottom portion of the flattened-curved surface 504 around the parabolic edge of the bottom surface 504, and let the corresponding two sheets of hooks and loops stick to each other. For example, the loops 580 on the bottom surface 506, shown in FIG. 10B, can attach to the hooks 575 on the curve surface 504. Similarly, perform the same operation for the top surface 502. The hooks on the top surface are attached to the loops at the corners of the top portion of the curve surface. The flattened enhancer would then be expanded back into its predefined 3-D shape.

A number of embodiments have been described where the enhancer's predefined 3-dimensional structure can be flexibly collapsible into 2-dimensional flat surfaces on their corresponding boards or plates, with two of the surfaces do not need any space between them. In those embodiments, the 2-dimensional flat surfaces are connected.

FIGS. 11A-11F show other embodiments to collapse the enhancer from its pre-defined 3-dimensional shape. Using the corner-horn enhancer 200 to illustrate, the enhancer can be made of four boards, two for the side surfaces, one for the top surface and one for the bottom surface. The four boards are snapped together at their corresponding junctions. In this example, when collapsed, the four surfaces are not connected. They are on four separate plates or boards.

Figure 11C:
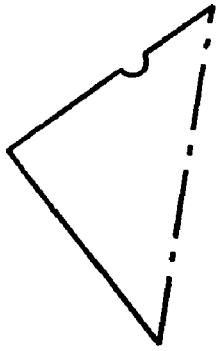
FIGS. 11A-11F show different embodiments of the invention to collapse the enhancer from its 3-dimensional shape.
Figure 11D:
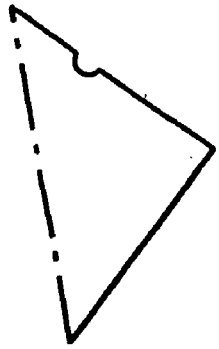
Figure 11B:
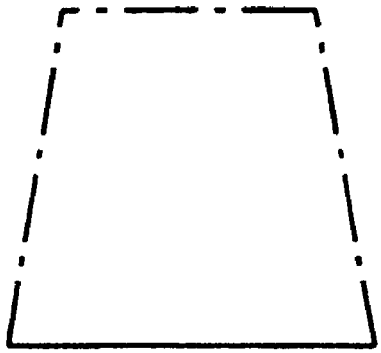
Figure 11A:
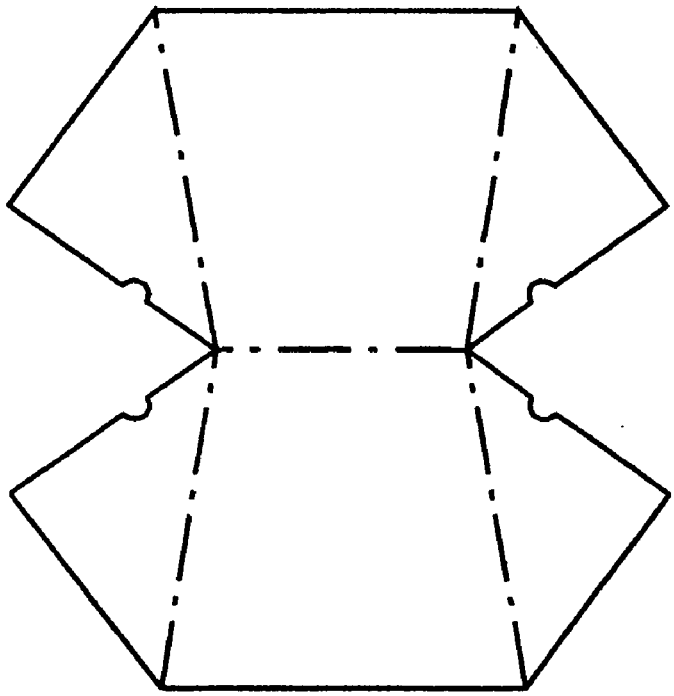

FIGS. 11A-11D show one embodiment showing the approach of having different surfaces described with their boards snapped, joint or attached together. To assemble the configuration shown in FIG. 11A, one approach uses six plates. The six plates are shown in FIGS. 11B-11D, with every figure depicting the shape of two of the plates. Each plate can be made of a foam board metallized on one side. If the plates are metallized on both sides, then the structures shown in FIG. 11C and 11D become interchangeable. The dot-dash lines shown in the figures indicate edges to be joined to form the pre-defined shape. Different techniques are applicable to join the edges together, and they include adhesive or mechanical arrangements. Examples of such techniques include self-stick tape, self-stick aluminum tape, tongue and groove carton technology, interlocking rectangular teeth, and hook and loop plastic removable fasteners.

Figure 11E:
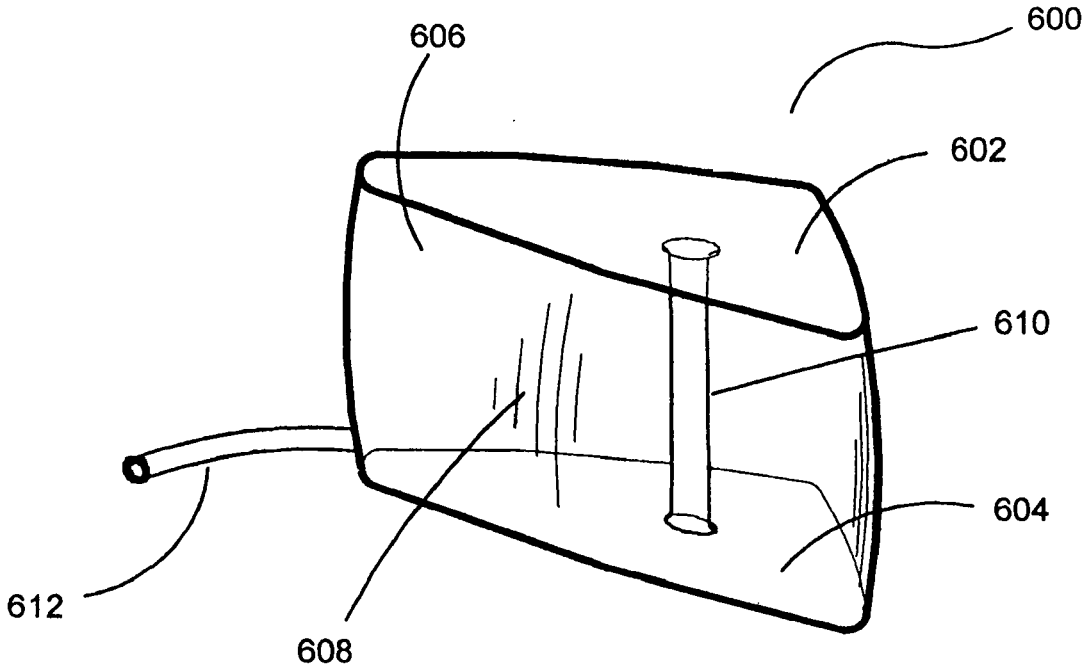

Another embodiment to collapse the enhancers is based on the concept of inflatable materials, like beach balls. One such embodiment 600 includes one or more plates or boards, as shown in FIG. 11E. It is explained based on the structure of a corner-horn enhancer. The enhancer 600 includes two triangular boards 602 and 604. They serve as the top and the bottom plates of the enhancer. The sides—dihedral and front sides—of the enhancer can be plastic films. The two dihedral sides are covered on the inside by metallic or reflecting surfaces. They can be, for example, aluminized flexible plastic films. The front side is not metallized. It can be a thin polyethylene film, or other types of films that are substantially transparent to electromagnetic radiations, particularly when they are very thin relative to the wavelength. The enhancer also includes an inner tube 610 that is open to the outside. The inner tube can be made of the same materials as the film for the front side 608 of the enhancer 600. To expand into its predefined 3-dimensional shape, the enhancer is inflated, for example, by air through an inlet 612. When inflated, the structure looks like a wedge with a through-hole 610 from its top to its bottom surface to position the antenna. To collapse the enhancer, one can open the inlet to release the air inside the structure. The top and the bottom plates would collapse, and the 3-dimensional structure can become 2-dimensional plates, one collapsed over the other, with their surfaces touching each other. In this example, the two plates are connected by the films. Other embodiments of an enhancer can be inflatable without having any plates or boards.

Figure 11F:
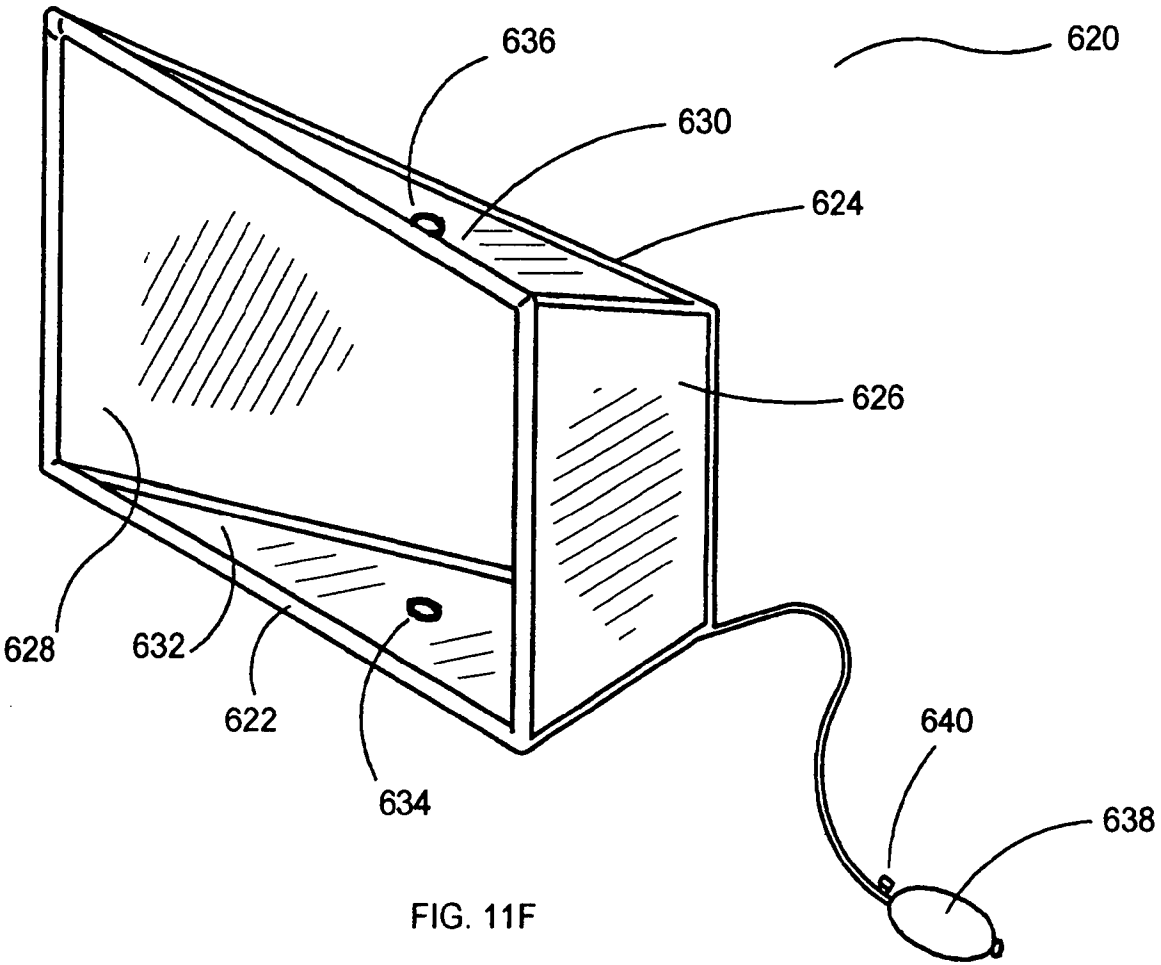

FIG. 11F illustrates another embodiment 620 of an inflatable enhancer that includes inflatable tubes. Again, it is explained based on the structure of a corner-horn enhancer. The tubes, such as 624 and 622, serve as the skeletal structure of the enhancer, and there are altogether nine tubes. All of the tubes are connected to an inlet, which can be connected to an air pump or bulb 638. In other words, the bulb can pump air into all of the tubes. The enhancer 620 also includes four films, 626, 628, 630 and 632. The inner surfaces of all four of the films can be metallized, or just the dihedral inner surfaces are metallized, with the top and bottom not. In one approach, to simplify the manufacturing process, all of the tubes and the films are made of the same plastic materials with metallized surfaces. There can again be two holes, 634 and 636, in the top and the bottom films. The two holes can have grommet-like structures in its inner lining.

When all the tubes are inflated, the enhancer will be in its pre-defined 3-dimensional shape. The antenna can then fit through one or two of the holes 634 and 636, with the bottom film 632 supported by, for example, the top surface 203 of the router 204. As in earlier embodiments, there can be an additional tube inserted through the two holes 634 and 636 to set the position of the antenna, if necessary. To collapse the enhancer, one only needs to release air by opening the valve 640. In yet another example, there can also be a non-metallic film on the front side of the enhancer as in the embodiment 600 shown in FIG. 11E.

Figure 12A:
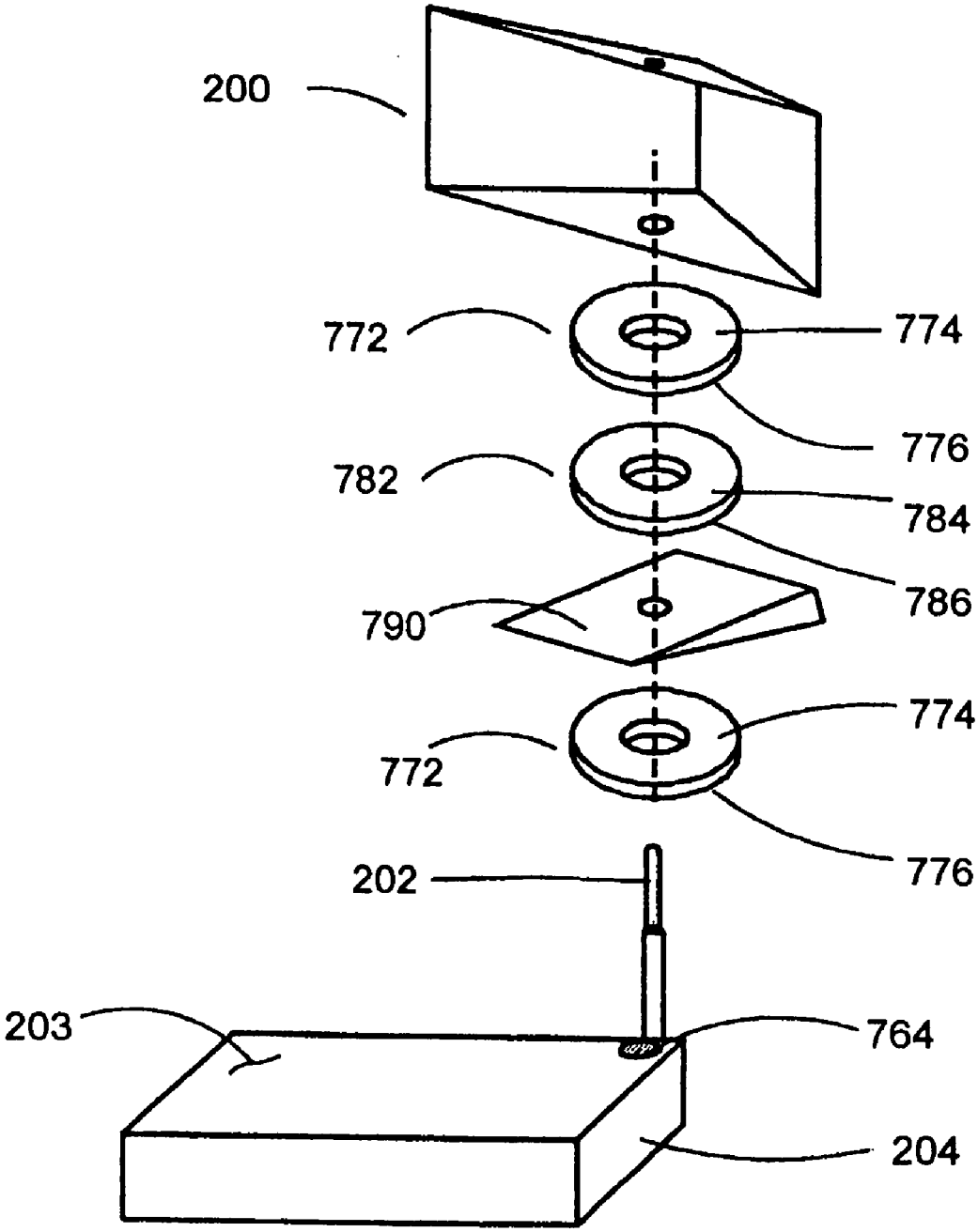
FIGS. 12A-12B show different embodiments of the invention to lock the position of an enhancer relative to an antenna.
Figure 12B:
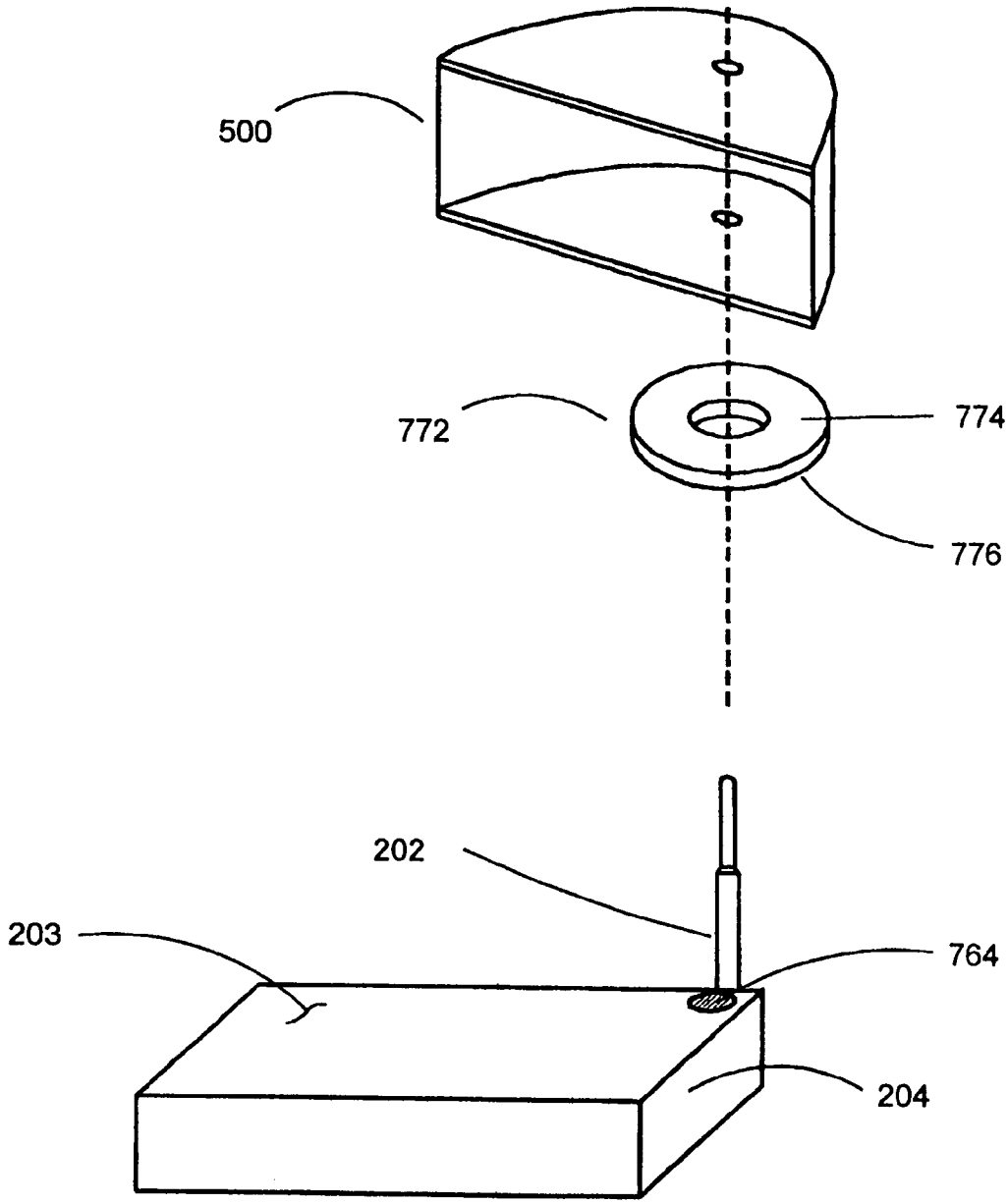

The position of the enhancer can be fixed relative to the antenna. In one embodiment, referring back to FIG. 3, the top surface of the router 204 is covered by a sheet of hooks, and there is a sheet of loops on the outside of the bottom surface 229. After the optimal position of the enhancer relative to the antenna is identified, that position can be fixed by pressing the sheet of hooks to the sheet of loops. FIGS. 12A-B illustrate two approaches for such VELCRO™-type locking or fixing implementation.

FIG. 12A illustrates the approach based on a corner-horn antenna 200. That approach includes a wedge 790. Since the corner-horn structure may not be in the shape of a rectangle, the wedge, with the right dimension, situated at the bottom surface of the enhancer, would allow the enhancer to sit on top of a router with the vertex of the enhancer to be substantially parallel to the orientation of the antenna. This approach includes using two different types of washers—a hook washer and a loop washer. The hook washer 772 has a sticky or adhesive surface 774. It can be a peel-and-stick tape, allowing a person to peel off a cover and expose the sticky surface. Another surface 776 of the hook washer 772 is covered by hooks, as in a piece of VELCRO™ hooks. The loop washer 782 again has an adhesive surface 786. However, the other surface 784 of the loop washer 782 is covered by loops, as in a piece of VELCRO™ loops. One way to lock the enhancer in position relative to the router 204 is as follows: (a) Stick a hook washer 772 at the bottom surface of the enhancer, (b) stick a loop washer 782 at the top surface of the wedge 790, (c) stick another hook washer 772 at the bottom surface of the wedge, and (d) stick a loop washer 782 on the top surface of the router. Then with the two sets of hook and loop washers, the enhancer 200 can be locked onto the wedge, and the wedge can be locked onto the router. Note that one does not need to use a loop washer 782 on the top surface of the router. A round patch 764 or other configuration of loops would also work. FIG. 12B illustrates similar attachment approach based on a parabolic enhancer 500, except that it does not need a wedge.

In another embodiment, there is a rotating plate between the enhancer and the router, with the antenna 202 being at the axis of rotation. The rotation of the plate can be controlled manually or by a stepping motor. After the optimal position of the enhancer relative to the antenna is identified, the position is locked in place.

The optimal position of the enhancer for the antenna can be determined in a computer assisted manner. The computer can assist with the calibration of the enhancer. In other words, the direction of the enhancer about the antenna can be determined. The calibration can be fully automatic or user assisted.

Figure 13A:
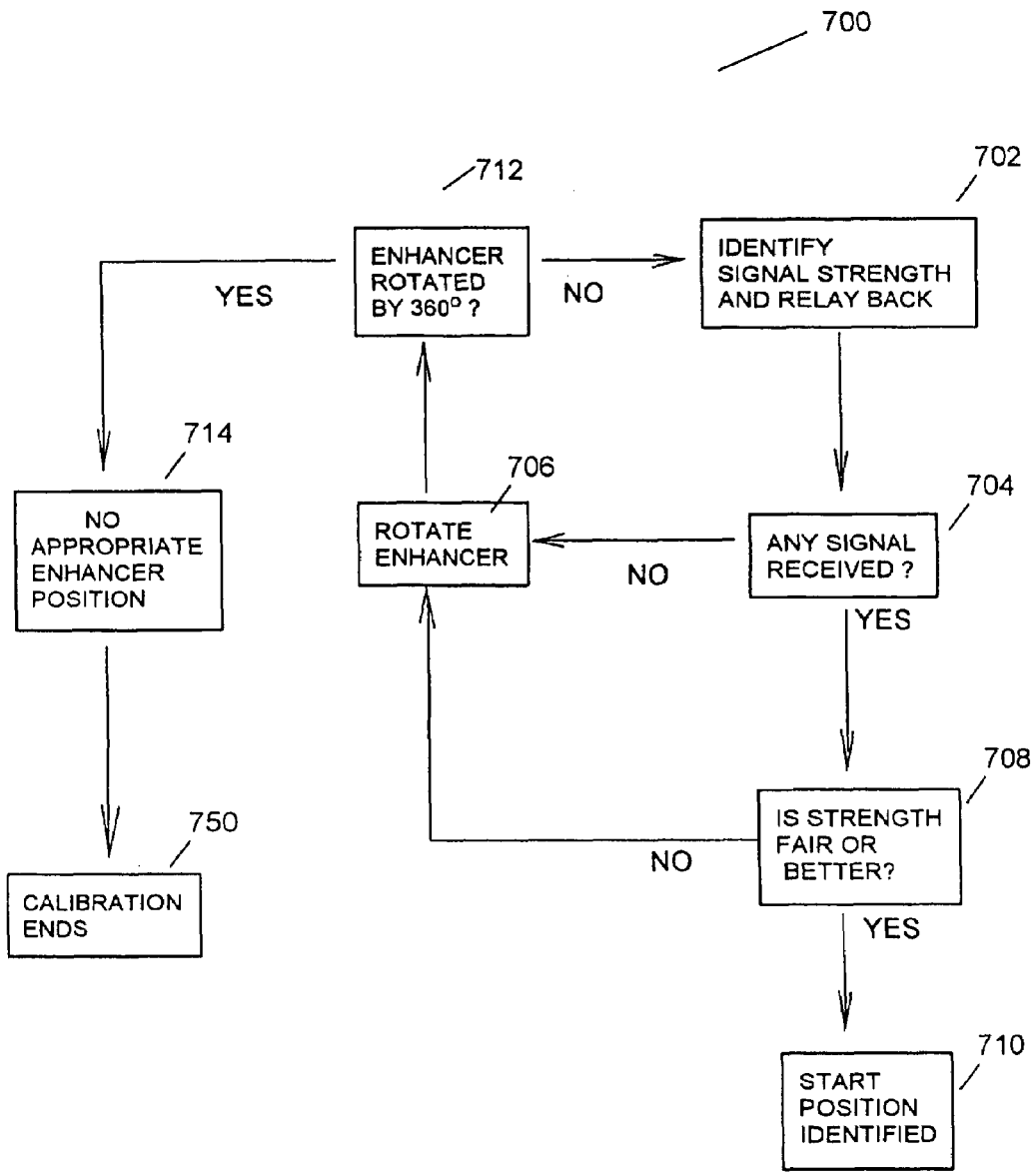
FIGS. 13A-13B show one embodiment of the invention to calibrate the position of the enhancer relative to the antenna so as to find an optimal position.
Figure 13B:
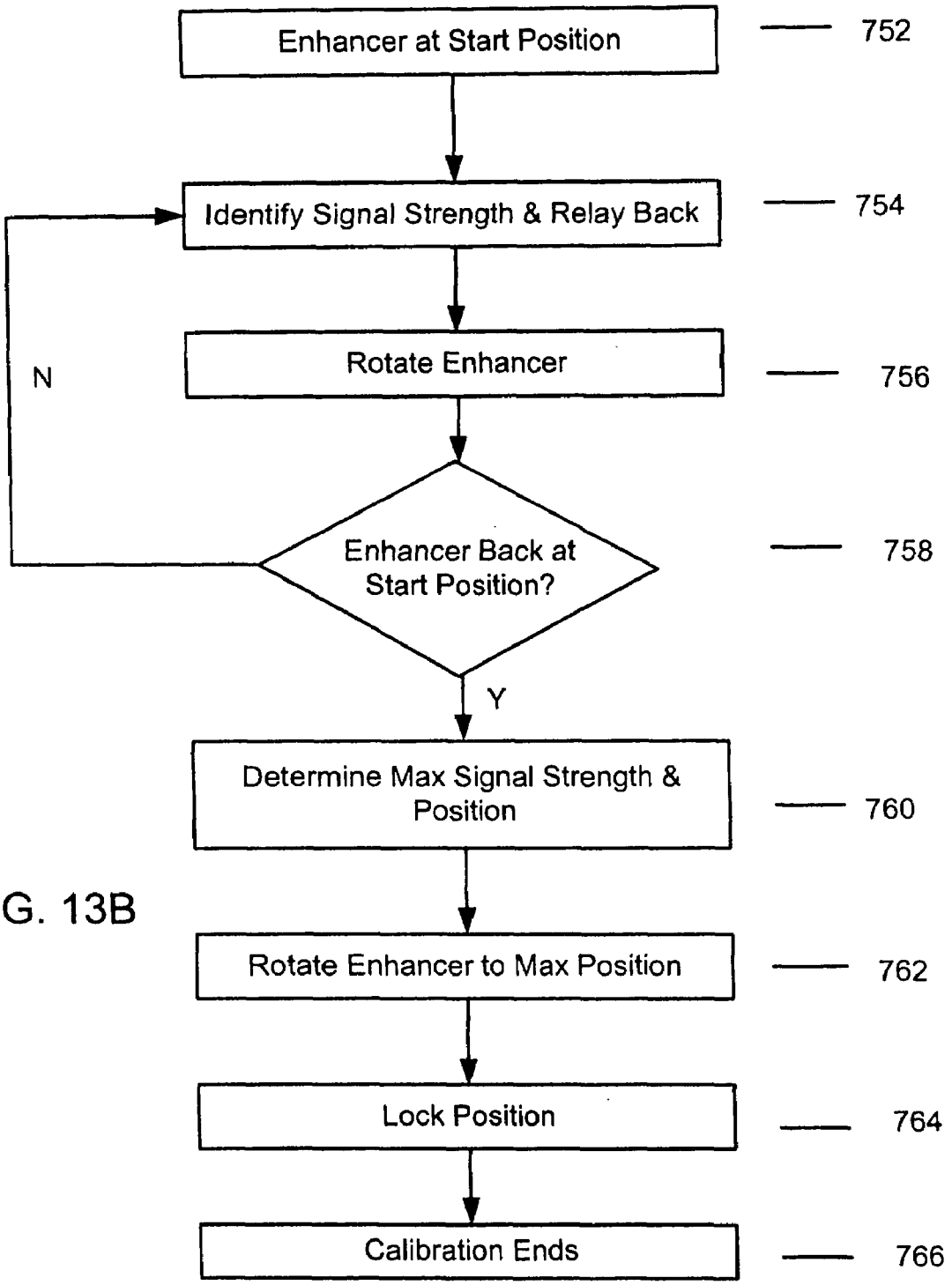

FIGS. 13A-13B show one embodiment to calibrate the position. This embodiment can depend on a stepping motor rotating the enhancer, as previously described, so that the calibration can be fully automatic. The process can be controlled by a position determinator in the computer, which can also control the stepping motor.

Note that there can be situations where the enhancer is not capable of improving the connections between the desktop and the portable. This can be due to many reasons. For example, the portable computer may be inoperable, or the router might have been turned off. Also, since the enhancer can improve the directivity of the antenna in certain direction, it can also decrease the directivity in other directions. As a result, one calibration approach is, in general terms, a two-step process. The first step is to determine 700 the starting point for calibration, and the second step is proceed with calibration from the starting point.

To determine the starting point, initially, the determinator can ask the portable computer to identify 702 the signal strength, such as the signals shown in FIG. 2A, and ask the portable to relay it back. After the request, the determinator determines 704 if any signal has been received. A threshold value can be set such that if the magnitude of the signals received is below the threshold, no signals are assumed received. If no signals have been received, the position determinator would rotate 706 the stepping motor by a preset amount, delta, which can be 10 degrees. The position determinator would also determine 712 whether the enhancer has rotated 360 degrees already. If the answer is no, the process of asking the portable to identify the signal strength repeats. However, if the enhancer has rotated by 360 degrees already, the determinator would conclude that no enhancer position 714 can provide decent signal strengths, and the calibration process ends, 750.

Referring back to the step of determining 704 whether there are any signals received, if the answer is yes, the position determinator would determine 708 if the signal strength is fair or better. Note that other thresholds can be set, but in this example, the threshold is set to fair or better. If the answer is no, again the enhancer would go through the process of rotating 706 enhancer by delta, testing 712 if enhancer has been rotated by 360 degrees and re-identifying 702 signal strength if appropriate. On the other hand, if the signal strength is fair or better, the start position 710 is identified.

FIG. 13B continues on with the calibration process after the start position 710 has been identified. First, the enhancer is set 752 at the start position. Then, the determinator asks the portable computer to identify 754 the signal strength and relay it back to the desktop. If signals are received, the determinator would keep track of the signal strength received, together with the corresponding enhancer position. If no signals are received, the determinator would ask the stepping motor to rotate 756 the enhancer by delta. The determinator would also determine 758 if the enhancer is back at its start position. If the answer is no, the process of asking for identifying signal strength and relaying back repeats. If the determinator decides that the enhancer has already been rotated 360 degrees, and is back at its start position, the determinator would compare the signals received, and determine 760 the maximum signal strength with the corresponding position. After the determination, the stepping motor would be ordered to rotate 762 to the position of maximum signal strength. The position of the enhancer can be locked 764, for example, by the stepping motor. At this point, the calibration process ends 766.

In the above embodiments, the determinator is assumed to reside in the desktop computer. However, the determinator can be embedded in the stepping motor, which then is in control of the calibration process. The determinator can also be in the portable computer.

It is not uncommon for the wireless router 204 to be conspicuously displayed in a house. With an enhancer coupled to the antenna 202 of the router 204, the enhancer can be in public display as well. In one embodiment, for aesthetic reasons, the antenna 202 with the tube 206 are not exposed, or are not visible from the outside, when the enhancer is attached to the antenna. For example, after the enhancer has been expanded into its predefined 3-dimensional shape, a piece of insulating material covers the mouth or opening of the enhancer. This piece of material can be a piece of cloth that is opaque, a board or a card. It can be integral to the enhancer or attached to the enhancer by clips or by VELCRO™.

Figure 14:
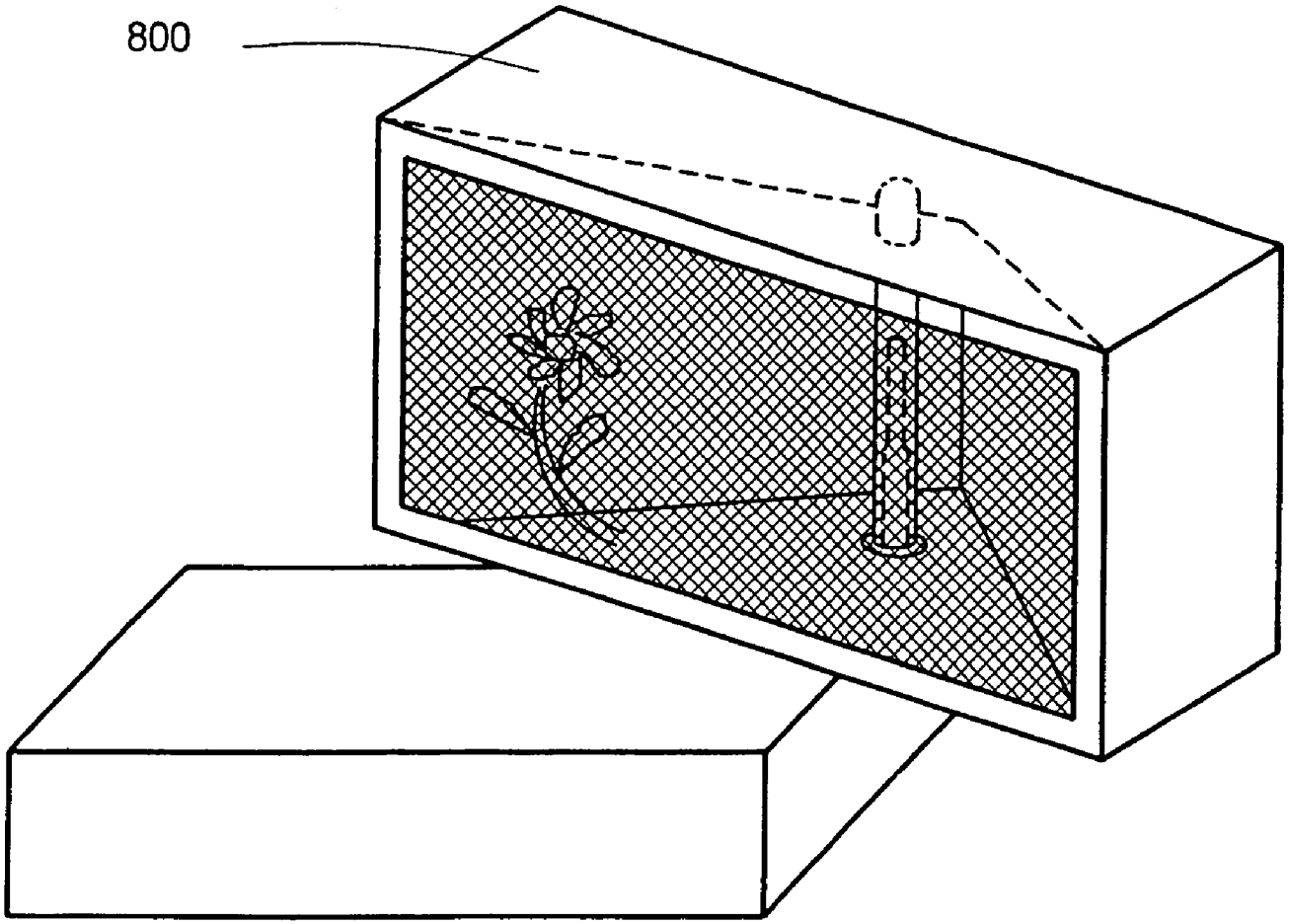
FIG. 14 shows an embodiment of the invention where the external 3-dimensional structure is different from the predefined 3-dimensional shape of the enhancer.

FIG. 14 shows an embodiment where the external 3-dimensional structure 800 is different from the predefined 3-dimensional shape of the enhancer. The external 3-dimensional structure 800 may be a more visually pleasing shape than the predefined 3-dimensional shape.

The front surface of the structure 800 can be covered by a film that is substantially transparent to microwave. It can be made of silk or polyethylene. One can even have pictures displayed on the film. In one embodiment, the front edges of the structure can be a picture frame, which allows a picture to be mounted on the front surface of the enhancer. In another embodiment, a portion (e.g., side or front surface) of the external 3-dimensional structure 800 can contain an advertisement (e.g., logo).

Figure 15:
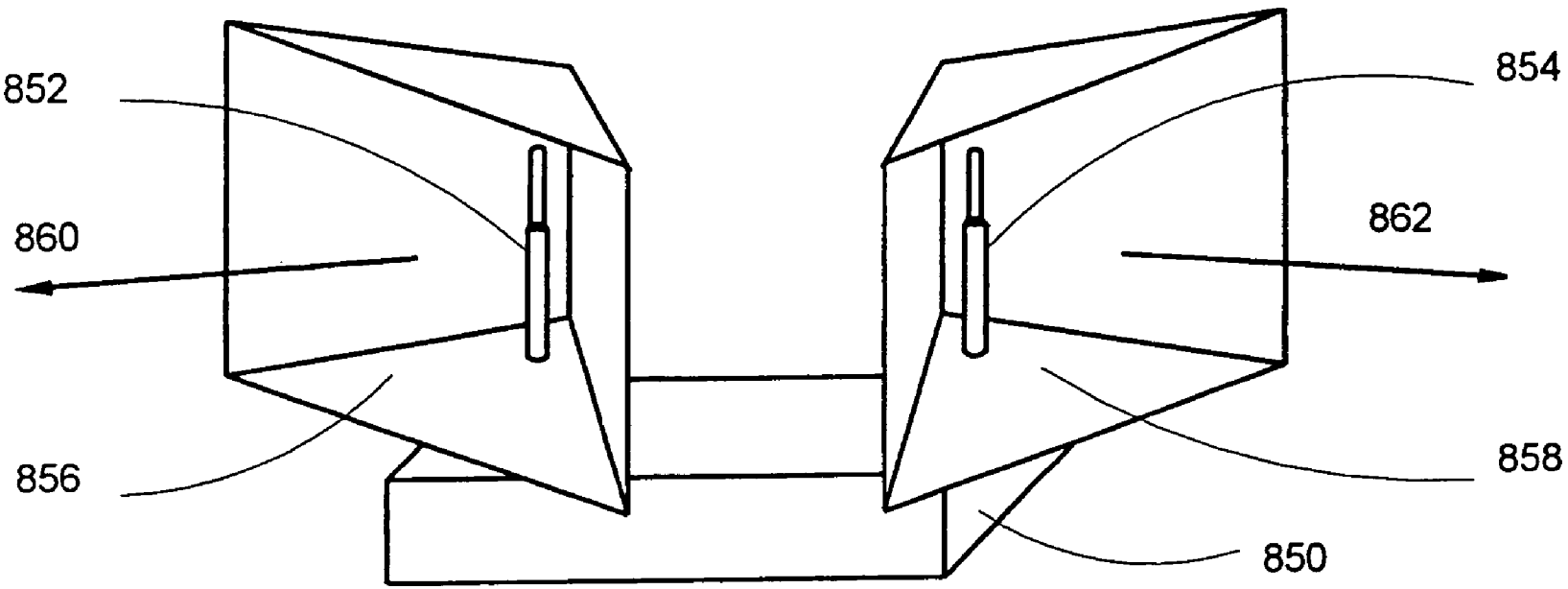
FIG. 15 shows the top view of a wireless router with two antennas, each coupled to an embodiment of the invention.

A number of embodiments have been described for a wireless router with one antenna. FIG. 15 shows the top view of a wireless router 850, with two antennas, 852 and 854. Each antenna is coupled to a corner-horn enhancer, 856 and 858, of the present invention. This 2-antenna version provides signal diversity, and allows for favoring signal links generally in two different directions, 860 and 862.

Note that there can also be more than one antenna formed, such as on a printed circuit board. In one embodiment, the enhancer is for enhancing the directivity of such multiple antenna structure.

Figure 16:
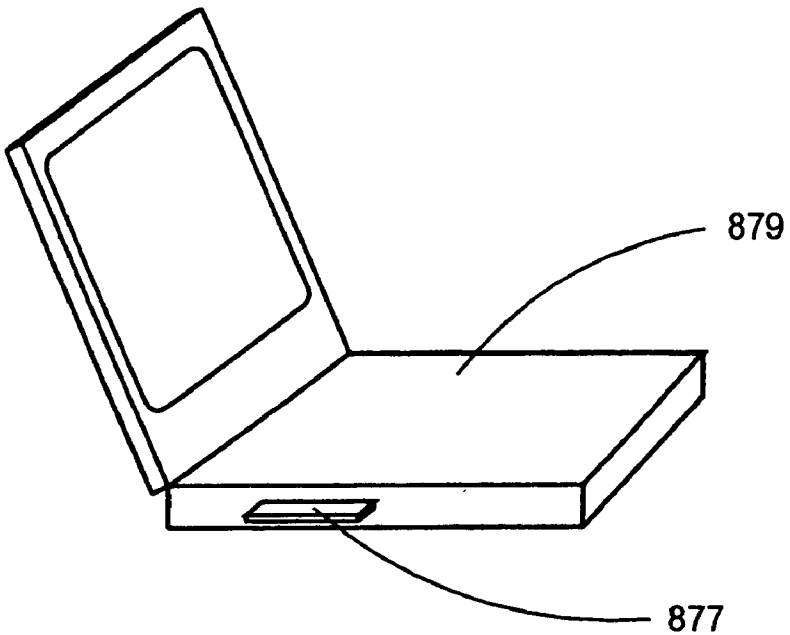
FIG. 16 shows one embodiment of the invention illustrating an enhancer for a wireless card antenna of an apparatus.
Figure 16:
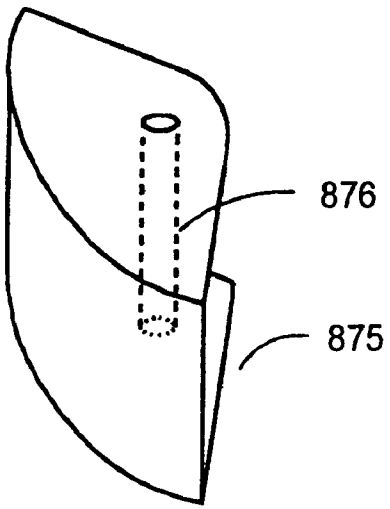

A number of embodiments have been described for wireless-router antenna. A wireless router can be considered as an access point or a point connecting a wired to a wireless network. In another embodiment, the enhancer is for enhancing the directivity of a wireless card antenna. FIG. 16 shows one embodiment of the invention illustrating an enhancer 875 for a wireless Ethernet antenna, or a wireless card antenna 877. The wireless card antenna can be coupled to an apparatus, such as a computer 879, which can be a portable computer. The wireless card antenna is typically located outside the computer. The enhancer 875 can be a parabolic reflector with a focal length that is longer than the parabolic enhancer 500 shown in FIG. 8A. For example, the focal length is 25 cm. The enhancer 875 improves the signal link to the wireless card antenna 877 in certain directions. In the embodiment of the enhancer 875 shown in FIG. 16, there can be a non-metallic or insulating tube 876 between the top and the bottom sheets or surfaces. The tube helps keep the two sheets or surfaces parallel to each other.

The enhancer for the wireless card antenna can be similar to the previously described enhancers for the wireless router. For example, the enhancer can again be in the shape of the corner-horn. In one embodiment, the size of the enhancer for the wireless card antenna is smaller than the enhancers previously described. They can be comparable to the size of the wireless card.

The enhancer for the wireless card antenna can be located securely relative to the antenna at an optimal position. For example, the computer can sit on top of a piece of material, such as a piece of cloth or a board. The enhancer is positioned at its optimal position, and is attached to the piece of material, such as through VELCRO™.

The present invention can also be applicable to an antenna embedded in an apparatus. For example, one can focus energies or increase signal intensity at the position of the antenna to increase the signal strength of the antenna. One mechanism to increase the signal intensity is to use the enhancer 875 shown in FIG. 16.

In another embodiment, a reflector (not shown) could attach (e.g., clip-on) to the display (or top) portion, the base portion, or the card itself of the computer 879. Such a reflector could enhance the wireless card antenna 877.

Figure 17:
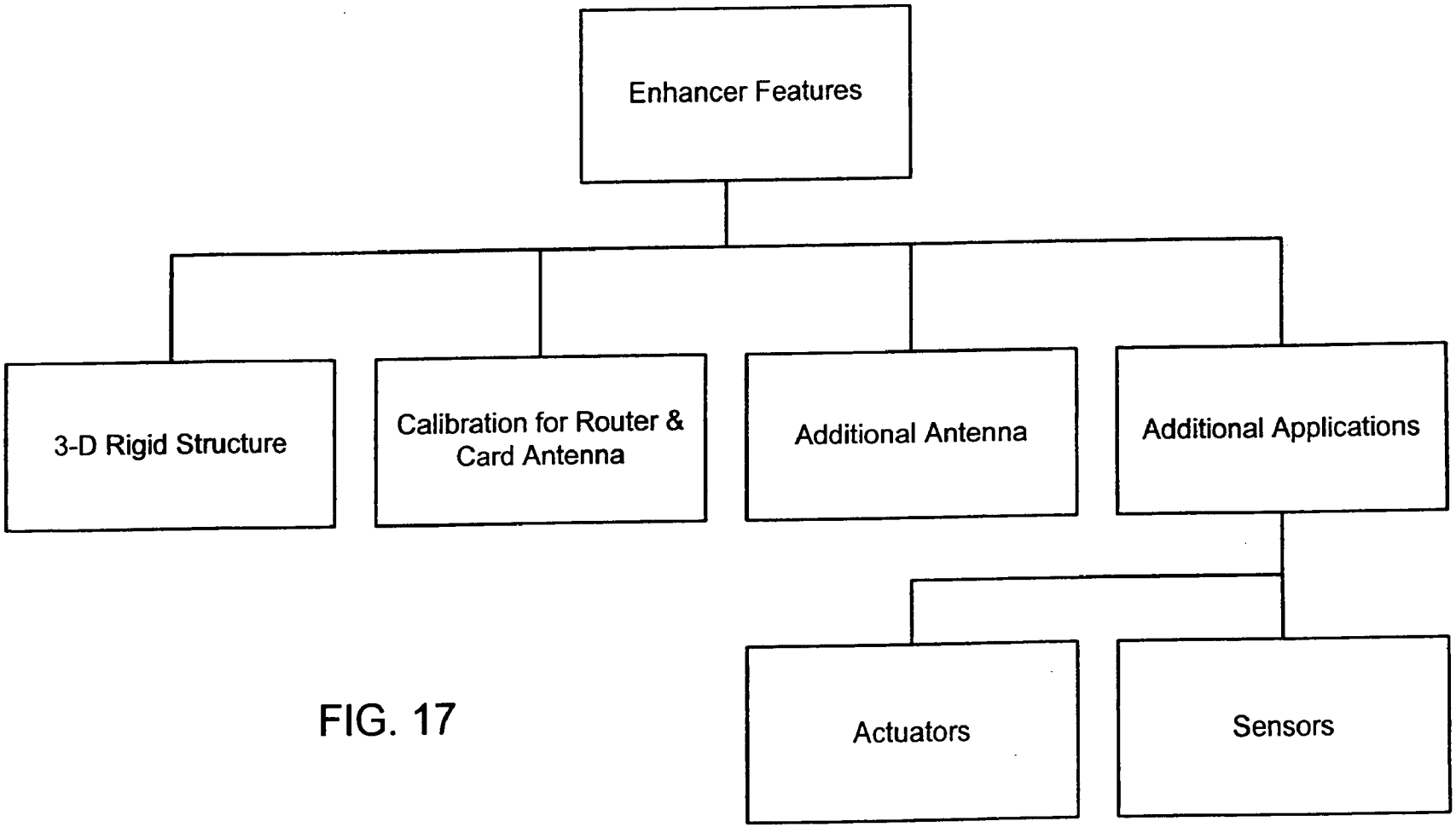
FIG. 17 shows a number of additional embodiments of the present invention for the enhancer.

FIG. 17 shows a number of additional embodiments for the enhancer. A number of embodiments have been described where the enhancer is flexibly collapsible. In one embodiment, the enhancer is not flexibly collapsible. Its predefined 3-dimensional shape is not flexibly collapsible into 2-dimensional flat surfaces. Instead, the enhancer has a rigid 3-D structure. It can be made of plain aluminum alloy sheets that are more than 4 mils thick. In one embodiment, the sheets are less than 22 mils thick.

A number of embodiments have been described on calibrating an enhancer for a wireless router. In one embodiment, there are two enhancers, for example, one for the desktop computer antenna and the other for the portable computer antenna. One approach to calibrate the enhancers is to fix the position of one enhancer relative to its corresponding antenna. Then, the calibration process as previously described can be applied to the other enhancer relative to the other antenna.

Different embodiments have been described for improving the connections between two communication devices—one can be a desktop computer and the other a portable computer. In one embodiment, there can be a third communication device in the middle. For example, the third communication device is a hub. A desktop computer can be wirelessly linked to the hub through Bluetooth, WiFi or other mechanisms. The linkage can be through a USB or a PCMCIA card antenna at the desktop computer. At the hub, there can be a WiFi dipole antenna or a wireless card antenna. The enhancer can enhance the antenna of the hub so as to improve its signals to the portable computer.

Figure 18A:
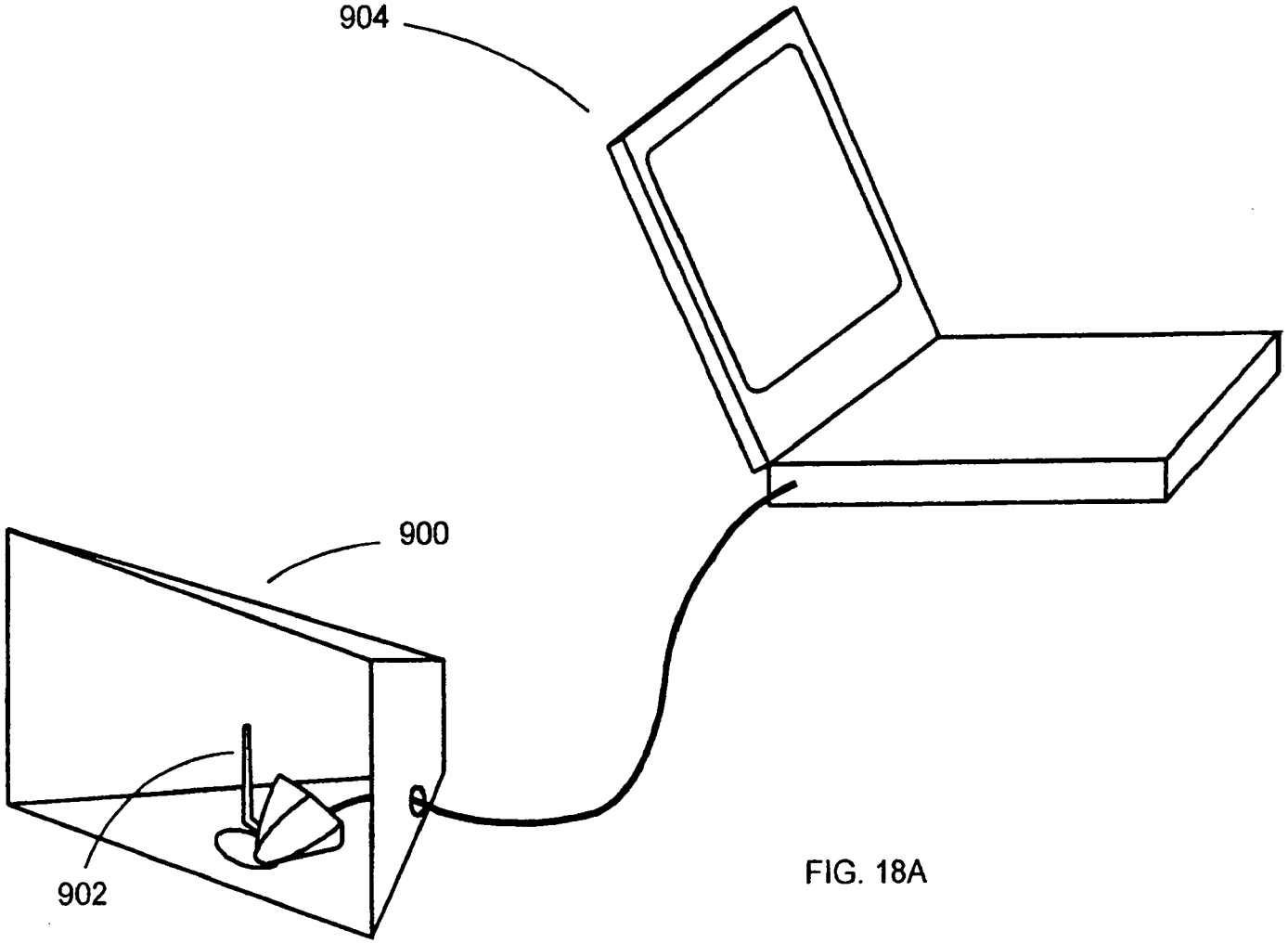
FIGS. 18A-18B show different embodiments of enhancers for antennas connected to I/O ports of a portable computer.

Note that the antenna for a portable computer does not have to be inserted or embedded into a computer. The antenna can be tethered and connected through one of the computer's I/O sockets, such as its USB port through an USB connector. FIG. 18A shows an enhancer 900 according to one embodiment of the present invention. The antenna 902 is connected to the portable computer 904 through its USB port. The antenna 902 is located in the enhancer 900, which has a hole to allow the antenna stay connected to the computer. The antenna 902, enhancing the directivity of the antenna 902, can be a corner-horn enhancer, a parabolic enhancer or other embodiments as described in the present invention. The enhancer can focus energies to the antenna to increase the signal strengths of the antenna.

Figure 18B:
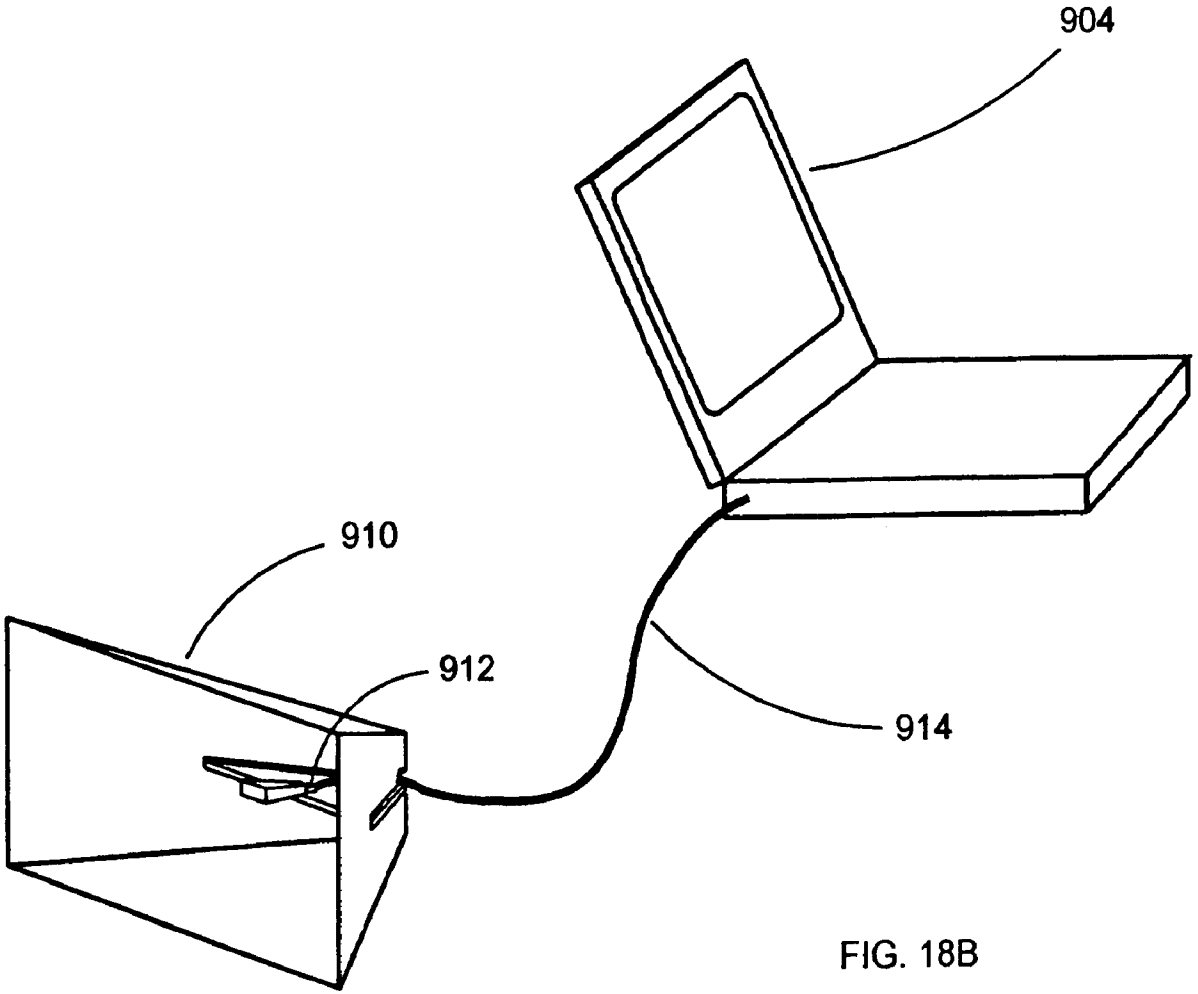

In yet another embodiment of the invention, the antenna can be in a hole at the vertex of the dihedral surface of the enhancer. The center of the hole can be at the midpoint of the vertex. The tethered antenna can be connected to a port (e.g., the USB port) of the computer. In one embodiment, there can also be a connector, such as a USB connector, at the vertex of the enhancer. The antenna can be placed inside the enhancer and connected to the connector. The connector, whether part of the enhancer or a separate part, can be used to hold the antenna in place within the enhancer. However, sometimes the location and the size of the antenna may not be appropriate to maximize the amount of energy to be coupled into the antenna. FIG. 18B shows an embodiment 910 for such an antenna 912, except that the antenna 912 is positioned on a non-metallic or insulating board inside the enhancer 910. The positioning can be for maximizing the amount of electromagnetic energies to be coupled into the antenna. The board can be positioned by a slot in the enhancer 910. A cable 914 can be connected to the connector, extending outside of the enhancer to the computer 904. The antenna 912 can, for example, be a wireless transceiver as well as its antenna.

The above descriptions focus on connections between a desktop computer and a portable computer. However, the present invention is applicable to other types of network computers. For example, the wireless connections can be among computers, sensors or actuators. To illustrate, a sensor with a dipole antenna would try to wirelessly connect to an actuator. One embodiment of an enhancer can be attached to the dipole to improve the connection between the sensor and the actuator.

From the foregoing it should be appreciated that the different embodiments of invented enhancers improve antenna directivities. Or, from a different perspective, the enhancer focuses electromagnetic energy for an antenna. With more energy condensed, the antenna captures more power. Through the enhancement, signal-to-noise ratios of wireless links are improved, discrimination against interfering channels is increased, and communication-link performance/quality becomes better. This in turn reduces the amount of power required, and increases privacy. The different embodiments can take a wide rage of different configurations and sizes.

In a number of embodiments, the enhancer is flexibly collapsible. The enhancer according to the invention is relatively small in size and lightweight making it easily shipped or transported.

Different embodiments of the present invention are very versatile. They are applicable to different types of antennas, particularly to monopole or dipole antennas. This can include dipoles fed by a coaxial cable or connector. Applications include enhancing directivity for antennas used in areas, such as, Bluetooth, WiFi, GPS, and cellular and Cordless phones.

The various embodiments, implementations and features of the invention noted above can be combined in various ways or used separately. Those skilled in the art will understand from the description that the invention can be equally applied to or used in other various different settings with respect to various combinations, embodiments, implementations or features provided in the description herein.

Numerous specific details are set forth in order to provide a thorough understanding of the present invention. However, it will become obvious to those skilled in the art that the invention may be practiced without these specific details. The description and representation herein are the common meanings used by those experienced or skilled in the art to most effectively convey the substance of their work to others skilled in the art. In other instances, well-known methods, procedures, components, and circuitry have not been described in detail to avoid unnecessarily obscuring aspects of the present invention.

Also, in this specification, reference to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments. Further, the order of blocks in process flowcharts or diagrams representing one or more embodiments of the invention do not inherently indicate any particular order nor imply any limitations in the invention.

Other embodiments of the invention will be apparent to those skilled in the art from a consideration of this specification or practice of the invention disclosed herein. It is intended that the specification and examples be considered as exemplary only, with the true scope and spirit of the invention being indicated by the following claims.

The invention claimed is:

1. A collapsible antenna enhancing device, comprising:

an extended configuration forming a predetermined three-dimensional arrangement of at least four sides, with at least one of the sides providing a reflective surface for electromagnetic radiation; and a compressed configuration suitable for storage or shipment in which the plurality of sides collapse down to a substantially two-dimensional arrangement, wherein said collapsible antenna enhancing device is adapted to return to said extended configuration from said compressed configuration and vice versa, and wherein the at least four sides include two sides connected at an edge, and another side in contact with the two sides, with the another side configured to position an antenna relative to the two sides.

2. An antenna directivity enhancer to enhance the directivity of an antenna comprising:

a 3-dimensional structure having a predefined 3-dimensional shape when assembled to enhance the directivity of the antenna, the 3-dimensional shape including one curved reflecting surface for electromagnetic radiation connected to at least two support surfaces where there is a gap in between the two surfaces, wherein when the enhancer is in the 3-dimensional shape, at least one support surface is not coplanar to the curved reflecting surface, wherein the 3-dimensional structure is adapted to be disassembled into substantially 2-dimensional surfaces, and wherein the enhancer is adapted to return from the substantially 2-dimensional surfaces to the 3-dimensional structure.

3. An antenna directivity enhancer as recited in claim 2, wherein the at least one support surface is substantially perpendicular to the curved reflecting surface when the enhancer is in the predefined 3-dimensional shape, and wherein when the enhancer is in the 3-dimensional shape, the at least one support surface is configured to maintain the curvature of the curved reflecting surface.

4. An antenna directivity enhancer as recited in claim 2, wherein the at least one support surface has at least a hole, and wherein when the enhancer is in the predefined 3-dimensional shape to operate to enhance the directivity of the antenna, the antenna extends through the hole, which is configured to position the antenna relative to the enhancer.

5. An antenna directivity enhancer as recited in claim 4, wherein the antenna faces the concave side of the curved reflecting surface when the enhancer is operating to enhance the directivity of the antenna.

6. An antenna directivity enhancer as recited in claim 4, wherein the shortest distance between the center of the hole and the reflecting surface when the enhancer is in the predefined 3-dimensional shape is greater than about 0.25 times of the wavelength of the radiation of the antenna.

7. An antenna directivity enhancer as recited in claim 4, wherein said antenna directivity enhancer has a focal point when the enhancer is in the predefined 3-dimensional shape, and the hole is substantially positioned at the focal point.

8. An antenna directivity enhancer as recited in claim 2, wherein the curved reflecting surface is parabolic in shape when the enhancer is in the predefined 3-dimensional shape.

9. An antenna directivity enhancer as recited in claim 2, wherein the antenna is for a wireless router.

10. An antenna directivity enhancer as recited in claim 2, wherein at least one of the surfaces is linked to an advertisement.

11. An antenna directivity enhancer as recited in claim 2, wherein the antenna is for establishing wireless connection with a different antenna; and wherein the different antenna also has an antenna directivity enhancer.

12. An antenna directivity enhancer as recited in claim 2, wherein when the enhancer is in the 3-dimensional shape, both support surfaces are not coplanar to the curved reflecting surface.

13. An antenna directivity enhancer as recited in claim 12, wherein both support surfaces are substantially parallel when the enhancer is in the predefined 3-dimensional shape, and wherein when the enhancer is in the 3-dimensional shape, the support surfaces are configured to maintain the curvature of the curved reflecting surface.

14. An antenna directivity enhancer as recited in claim 12, wherein each of the support surfaces has at least a hole, and wherein when the enhancer is in the predefined 3-dimensional shape to operate to enhance the directivity of the antenna, the antenna extends through the two holes, which are configured to position the antenna relative to the enhancer.

15. An antenna directivity enhancer as recited in claim 12, wherein the antenna is for a wireless router.

16. An antenna directivity enhancer as recited in claim 12, wherein at least one of the surfaces is linked to an advertisement.

17. An antenna directivity enhancer as recited in claim 12, wherein the antenna is for establishing wireless connection with a different antenna; and wherein the different antenna also has an antenna directivity enhancer.

18. An antenna enhancing device, comprising:

an extended configuration forming a predetermined three-dimensional arrangement with at least a curved reflective surface for electromagnetic radiation at a first side, and at least two other sides with a gap in between, where the two other sides are not coplanar but are connected to the first side; and a compressed configuration suitable for storage or shipment in which the three-dimensional arrangement compresses down to a substantially two-dimensional arrangement, wherein said antenna enhancing device is adapted to return to said extended configuration from said compressed configuration and vice versa.

19. An antenna enhancing device as recited in claim 18, wherein the three-dimensional arrangement compresses down to the substantially two-dimensional arrangement by disassembly of the one or more sides of said extended configuration.

* * * * *